US007395012B2

(12) United States Patent
Kojima

(10) Patent No.: US 7,395,012 B2
(45) Date of Patent: Jul. 1, 2008

(54) POSITION SETTING METHOD OF PHOTOSENSITIVE BODY AND IMAGE FORMING APPARATUS

(75) Inventor: Tomoyuki Kojima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 320 days.

(21) Appl. No.: 11/144,894

(22) Filed: Jun. 3, 2005

(65) Prior Publication Data

US 2005/0271418 A1 Dec. 8, 2005

(30) Foreign Application Priority Data

Jun. 4, 2004 (JP) ..... 2004-167018

(51) Int. Cl.
*G03G 15/00* (2006.01)

(52) U.S. Cl. ..... 399/167; 399/300; 399/302; 399/308

(58) Field of Classification Search ..... 399/167, 399/298, 299, 300, 302, 303, 308
See application file for complete search history.

(56) References Cited

U.S. PATENT DOCUMENTS 6,070,041 A * 5/2000 Nakayasu et al. ..... 399/301
6,360,070 B1 3/2002 Taka et al.

FOREIGN PATENT DOCUMENTS

JP 2000-187428 A 7/2000

* cited by examiner

*Primary Examiner*—David M Gray
*Assistant Examiner*—Ryan D. Walsh
(74) *Attorney, Agent, or Firm*—Panitch Schwarze Belisario & Nadel LLP

(57) ABSTRACT

A drum/belt drive starting procedure simultaneous starts the rotation of photosensitive drums and the conveyance of a belt. A drum/belt driving time calculating procedure sets a rotational drive stop time of each photosensitive drum and a conveyance drive stop time of the conveying belt on the basis of a detection result of a reference mark detecting unit. A drum/belt drive stopping procedure stops the rotation of each photosensitive drum and the conveyance of the conveying belt on the basis of a calculation result of the drum/belt driving time calculating procedure. Rotational phase differences of every plural photosensitive drums are set to a predetermined value in the state where rubbing with the belt is small.

6 Claims, 14 Drawing Sheets

POSITION SETTING METHOD OF PHOTOSENSITIVE BODY AND IMAGE FORMING APPARATUS

BACKGROUND OF THE INVENTION

1. Field of the Invention

The invention relates to a position setting method of a photosensitive body for suppressing friction between a belt and the photosensitive body as an image holding body and to an image forming apparatus.

2. Related Background Art

Ordinarily, in a multicolor image forming apparatus such as a color electrophotographic printer or the like, for example, image holding bodies (hereinbelow, referred to as photosensitive drums) for forming toner images of K (black), Y (yellow), M (magenta), and C (cyan) are arranged in a line on a belt at predetermined intervals. In the following description, for example, it is assumed that the photosensitive drums are arranged from an upstream in the conveying direction of a sheet toward its downstream in order of K, Y, M, and C.

In order to simultaneously start the rotation of those four photosensitive drums, simultaneously stop the rotation of them, and laminate the toner images of four colors of K, Y, M, and C to the same position on the sheet conveyed on the belt, assuming that time when an image is irradiated onto the photosensitive drum K is set to reference time Tk, time Ty when an image is irradiated onto the photosensitive drum Y has to be equal to time after the elapse of time Lky/V obtained by dividing a distance Lky from a contact point of the photosensitive drum K and the belt to a contact point of the photosensitive drum Y and the belt by a conveying speed V of the belt.

Time Tm when an image is irradiated onto the photosensitive drum M has to be equal to time after the elapse of time Lkm/V obtained by dividing a distance Lkm from the contact point of the photosensitive drum K and the belt to a contact point of the photosensitive drum M and the belt by the conveying speed V of the belt. Similarly, time Tc when an image is irradiated onto the photosensitive drum C has to be equal to time after the elapse of time Lkc/V obtained by dividing a distance Lkc from the contact point of the photosensitive drum K and the belt to a contact point of the photosensitive drum C and the belt by the conveying speed V of the belt.

However, even if the irradiating time is accurately set as mentioned above, there is a case where a positional deviation (hereinafter, referred to as a color drift) occurs among the toner images of four colors of K, Y, M, and C due to an eccentricity or the like of each of the photosensitive drums. A technique for making the occurrence of the color drift inconspicuous by periodically making the generation timing of the color drift coincident has been disclosed (for example, refer to JP-A-2000-187428).

According to such a technique, a reference point is added to each of the four photosensitive drums and phase differences among the reference points of the four photosensitive drums are always held constant, thereby periodically making the generation timing of the color drift coincident. To always hold the phase differences among the reference points of the four photosensitive drums constant, a process for setting the phase differences among the reference points is executed in accordance with a predetermined procedure at a print start time point.

According to the process for setting the phase differences among the reference points, the belt is conveyed and while simultaneously rotating the four photosensitive drums, the reference points of the four photosensitive drums are detected by using reference mark detecting units. Subsequently, while the belt is conveyed, the photosensitive drums are individually stopped on the basis of each reference point detecting time (the photosensitive drum and the belt enter a rubbing state).

When the last photosensitive drum is stopped, the belt is also simultaneously stopped and the process for setting the phase differences among the reference points is completed. The stop time of each photosensitive drum is calculated from a relation between the reference point detecting time obtained by the reference point detecting units and rotational speeds of the four photosensitive drums. By setting the stopping timing as mentioned above, each time a printing step is executed, the phase differences among the four photosensitive drums are held constant, so that the color drift becomes inconspicuous.

A problem to be solved is that in the process for setting the phase differences among the reference points of the above conventional technique, while the belt is conveyed, the photosensitive drums are individually stopped on the basis of each reference point detecting time and simultaneously with the stop of the last photosensitive drum, the belt is also stopped. That is, according to such a process, the rubbing state between the photosensitive drum and the belt increases to a level larger than it is needed. Not only an abrasion between the photosensitive drum and the belt but also deflection occurs in the belt, so that the color drift is further liable to occur.

SUMMARY OF THE INVENTION

It is an object of the invention to provide a position setting method of a photosensitive body for suppressing a friction between a belt and the photosensitive body as an image holding body and an image forming apparatus.

According to the present invention, there is provided a position setting method of a photosensitive body in which a reference position of each of a plurality of photosensitive bodies arranged in a conveying unit is detected by a reference position detecting unit during rotation of the photosensitive bodies, the rotation of the plurality of photosensitive bodies and conveyance of the conveying unit are stopped at predetermined time on the basis of a result of the detection, and rotational phase differences of every the plurality of photosensitive bodies are set to a predetermined value, comprising:

a drum/belt driving time calculating step which sets rotational drive stop time of each of the plurality of photosensitive bodies and conveyance drive stop time of the conveying unit on the basis of the detection result of the reference position detecting unit; and a drive stopping step which stops the conveyance of the conveying unit in correspondence to drive stop timing of one of the photosensitive bodies on the basis of a result of the calculation of the drum/belt driving time calculating step.

Moreover, In the drum/belt driving time calculating step, the photosensitive body whose reference position has been detected first by the reference position detecting unit is set at reference rotational drive stop time and the rotational drive stop time is set in order of the photosensitive body whose reference position has subsequently been detected.

Moreover, in the drum/belt driving time calculating step, the photosensitive body into which the reference rotational drive stop time is set is changed every setting of the phase difference and the rotational drive stop time is set.

Moreover, in the drum/belt driving time calculating step, among the plurality of photosensitive bodies, the photosensitive body in which the accumulated number of rotating times is the smallest is selected and the reference rotational drive stop time is set.

Moreover, in the drum/belt driving time calculating step, among the rotational drive stop time excluding the earliest rotational drive stop time and the latest rotational drive stop time from the plurality of the rotational drive stop time of the plurality of photosensitive bodies, the stop time of the conveying unit is set to timing between the earliest rotational drive stop time and the latest rotational drive stop time.

Moreover, the method may further comprise at least either a drum speed changing step which calculates rotation amounts (rotational speeds×rotating time) of the plurality of photosensitive bodies and changes the rotational speeds while maintaining each of the rotation amounts every the plurality of photosensitive bodies, or a belt speed changing step which calculates a movement amount (moving speed× moving time) of the conveying unit and changes the moving speed while maintaining the movement amount, on the basis of the calculation result of the drum/belt driving time calculating step.

According to the present invention, there is also provided an image forming apparatus comprising:

a first photosensitive body and a second photosensitive body;

a first driving unit which gives a driving force to the first photosensitive body and a second driving unit which gives a driving force to the second photosensitive body;

a belt which is arranged between the first photosensitive body and the second photosensitive body;

a first mark whose position changes when the first photosensitive body rotates and a second mark whose position changes when the second photosensitive body rotates;

a first detecting unit which detects the first mark and a second detecting unit which detects the second mark; and a control unit which obtains a time difference between timing when the first mark passes through the first detecting unit and timing when the second mark passes through the second detecting unit, determines a time that is required until the second driving unit is stopped after the stop of the first driving unit, and set stop timing of the belt driving unit to timing between the stop of the first driving unit and the stop of the second driving unit.

In the apparatus, the first photosensitive body has a first photosensitive body gear which receives the driving force from the first driving unit, the second photosensitive body has a second photosensitive body gear which receives the driving force from the second driving unit, a position of the first mark is rotated synchronously with rotation of the first photosensitive body gear, and a position of the second mark is rotated synchronously with rotation of the second photosensitive body gear.

Moreover, in the apparatus, the control unit stops the belt driving unit together with the stop of the first driving unit and, thereafter, stops the second driving unit.

Moreover, The apparatus may further comprise a first photosensitive body driving gear which has the first mark, receives the driving force from the first driving unit, and rotates the first photosensitive body; and a second photosensitive body driving gear which has the second mark, receives the driving force from the second driving unit, and rotates the second photosensitive body.

Moreover, in the apparatus, the control unit stops the belt driving unit together with the stop of the first driving unit and, thereafter, stops the second driving unit.

According to the present invention, there is also provided an image forming apparatus comprising:

a plurality of photosensitive bodies and a plurality of driving units which rotate the photosensitive bodies;

a belt driving unit which drives a belt that is come into contact with the plurality of photosensitive bodies;

a plurality of detection sections which are rotated in association with the rotation of the photosensitive bodies;

a plurality of detecting units each of which is arranged so as to face each of the rotated detection sections at a same fixing position and outputs a detection signal when each of the rotated detection sections is detected at the facing position;

a drive control unit which simultaneously drives the plurality of driving units and drives the belt driving unit so as to simultaneously rotate the plurality of photosensitive bodies;

a stop control unit which discriminates rotational phase differences of the photosensitive bodies on the basis of a reception time difference each time a detection signal is received from each of the detecting units and sequentially stops the driving units of the photosensitive bodies in correspondence to the rotational phase differences; and a belt drive stopping unit which stops the belt driving unit before the driving unit whose stopping order is the last is stopped after the driving unit whose stopping order is the first was stopped.

By further adding the step of stopping the belt while rotating the photosensitive drum, a period of time during which the photosensitive drum and the belt enters the rubbing state can be further shortened. Therefore, a decrease in life of both of the belt and the photosensitive drum due to the rubbing between them is reduced and, further, the occurrence of the deflection in the belt can be prevented. Thus, such an effect that a preferable output image with a small color drift can be obtained.

The above and other objects and features of the present invention will become apparent from the following detailed description and the appended claims with reference to the accompanying drawings.

DETAILED DESCRIPTION OF THE PREFERRED EMBODIMENTS

A process for setting phase differences among reference points according to the invention is realized only by changing an executing program of a control procedure in the process for setting the phase differences among the reference points of the conventional technique.

Embodiment 1

Figure 1:
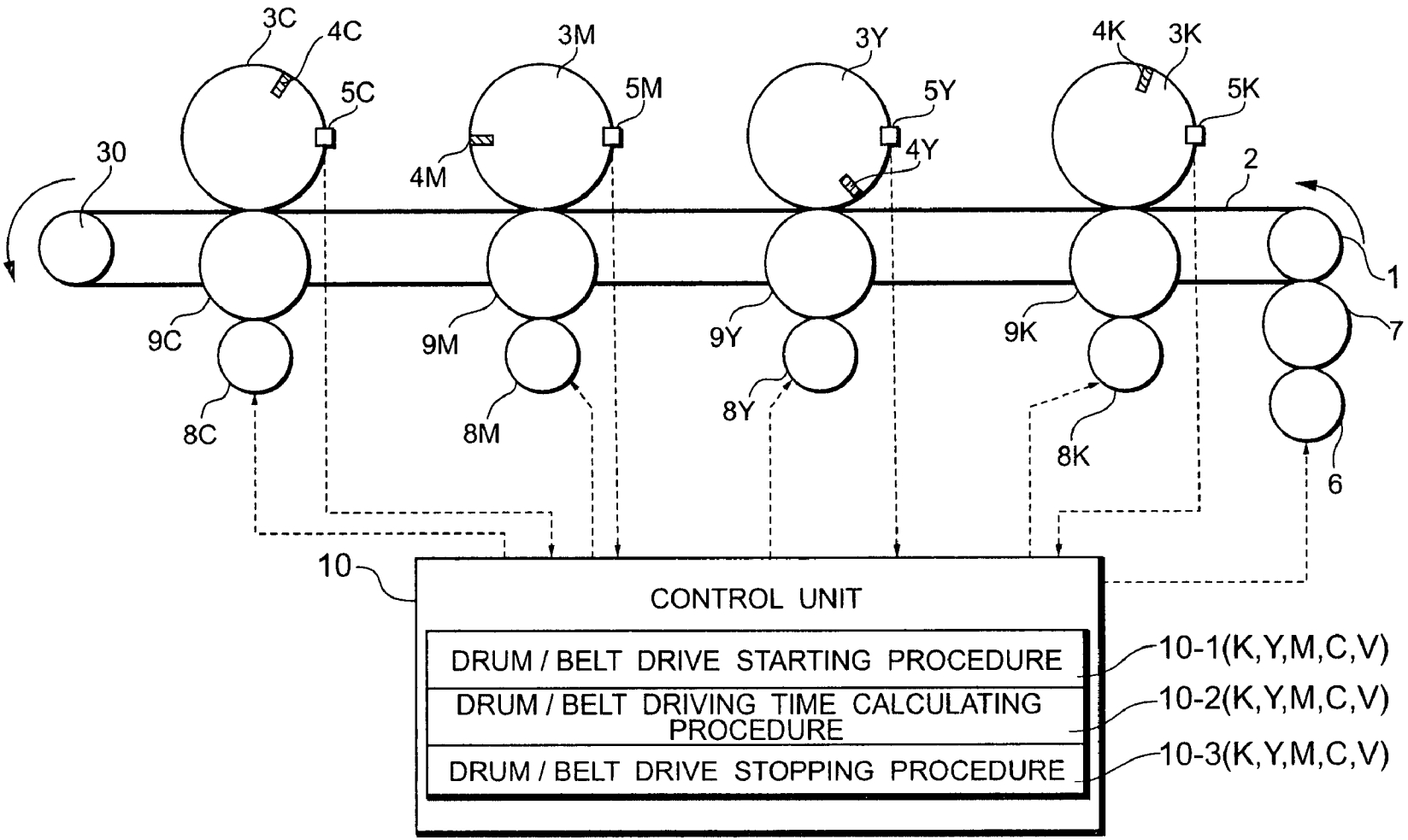
FIG. 1 is a block diagram of a construction of an embodiment 1.

FIG. 1 is a block diagram of a construction of an embodiment 1.

As shown in the diagram, an image forming apparatus to execute a position setting method of a photosensitive drum according to the embodiment 1 is constructed by: a belt roller 1; a belt 2; photosensitive drums 3 (K, Y, M, C); marks 4 (K, Y, M, C); reference mark detecting units 5 (K, Y, M, C); a belt driving unit 6; a belt driving gear 7; photosensitive drum driving units 8 (K, Y, M, C); photosensitive drum driving gears 9 (K, Y, M, C); and a control unit 10.

An outline of a print mechanism unit to which the invention is applied will now be described.

Figure 2:
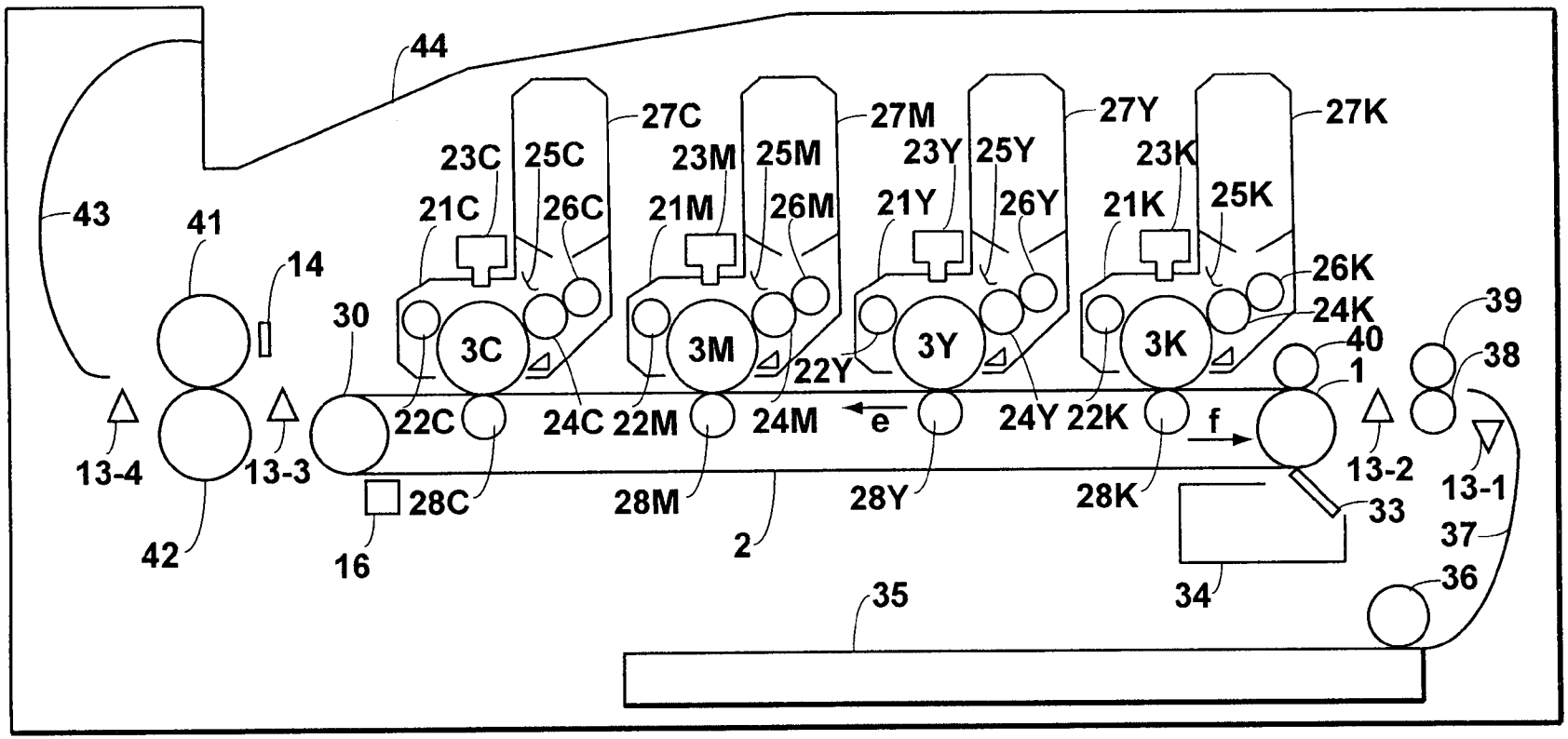
FIG. 2 is a schematic cross sectional view of a print mechanism unit of an image forming apparatus to which the invention is applied.

FIG. 2 is a cross sectional view of a main section of a print mechanism unit.

As shown in the diagram, four image forming units 21K, 21Y, 21M, and 21C are arranged in the print mechanism unit along a conveying path directing from an inserting side of a recording medium to its ejecting side. It is now assumed that K, Y, M, and C denote colors of black, yellow, magenta, and cyan (hereinafter, this is true of the following explanation). The photosensitive drums 3K, 3Y, 3M, and 3C whose surfaces are uniformly charged by charging rollers 22K, 22Y, 22M, and 22C are included in the image forming units 21K, 21Y, 21M, and 21C, respectively. Electrostatic latent images according to image data are formed on the surfaces of the photosensitive drums 3K, 3Y, 3M, and 3C by LED heads 23K, 23Y, 23M, and 23C.

Toner of predetermined colors is supplied to the electrostatic latent images from toner cartridges 27K, 27Y, 27M, and 27C by developing rollers 24K, 24Y, 24M, and 24C, developing blades 25K, 25Y, 25M, and 25C, sponge rollers 26K, 26Y, 26M, and 26C, and the like and developed.

By transfer rollers 28K, 28Y, 28M, and 28C, the toner which has developed the electrostatic latent images is transferred onto the recording medium conveyed on the conveying belt 2 in the direction from the image forming unit 21K to the image forming unit 21C.

A color drift detecting sensor 16 to detect a color drift, a cleaning blade 33, and a drain toner tank 34 are arranged around the conveying belt 2. The color drift detecting sensor 16 is a sensor for irradiating a predetermined light beam to a positional deviation detection pattern formed on the conveying belt 2, receiving its reflection light, and detecting a print positional deviation value. The cleaning blade 33 is a section for removing the positional deviation detection pattern formed on the conveying belt 2. The drain toner tank 34 is a section for enclosing the removed drain toner.

Upon printing, when the recording medium is picked up from a sheet enclosing cassette 35 by a hopping roller 36, it is guided by a guide 37 and reaches a resist roller 38. An oblique feeding or the like of the recording medium is corrected by the resist roller 38 and a pinch roller 39 which faces it. The recording medium is conveyed to a position between an adsorbing roller 40 and the conveying belt 2 by the resist roller 38. The adsorbing roller 40 allows the recording medium to be come into pressure contact with the belt roller 1, thereby charging the recording medium and allowing it to be electrostatically adsorbed onto the conveying belt 2.

The recording medium on which the toner images have been transferred by the transfer rollers 28K, 28Y, 28M, and 28C is sent to a heat roller 41 and a pressing roller 42. In this position, the toner images are heated and fixed onto the recording medium. A temperature of the heat roller 41 is detected by a thermistor 14.

The recording medium after the fixing passes through a guide 43 and is enclosed onto a stacker 44 and a printing process is finished.

To detect the position of the recording medium during the processing steps described above, position sensors 13-1, 13-2, 13-3, and 13-4 are arranged in predetermined positions.

Figure 3:
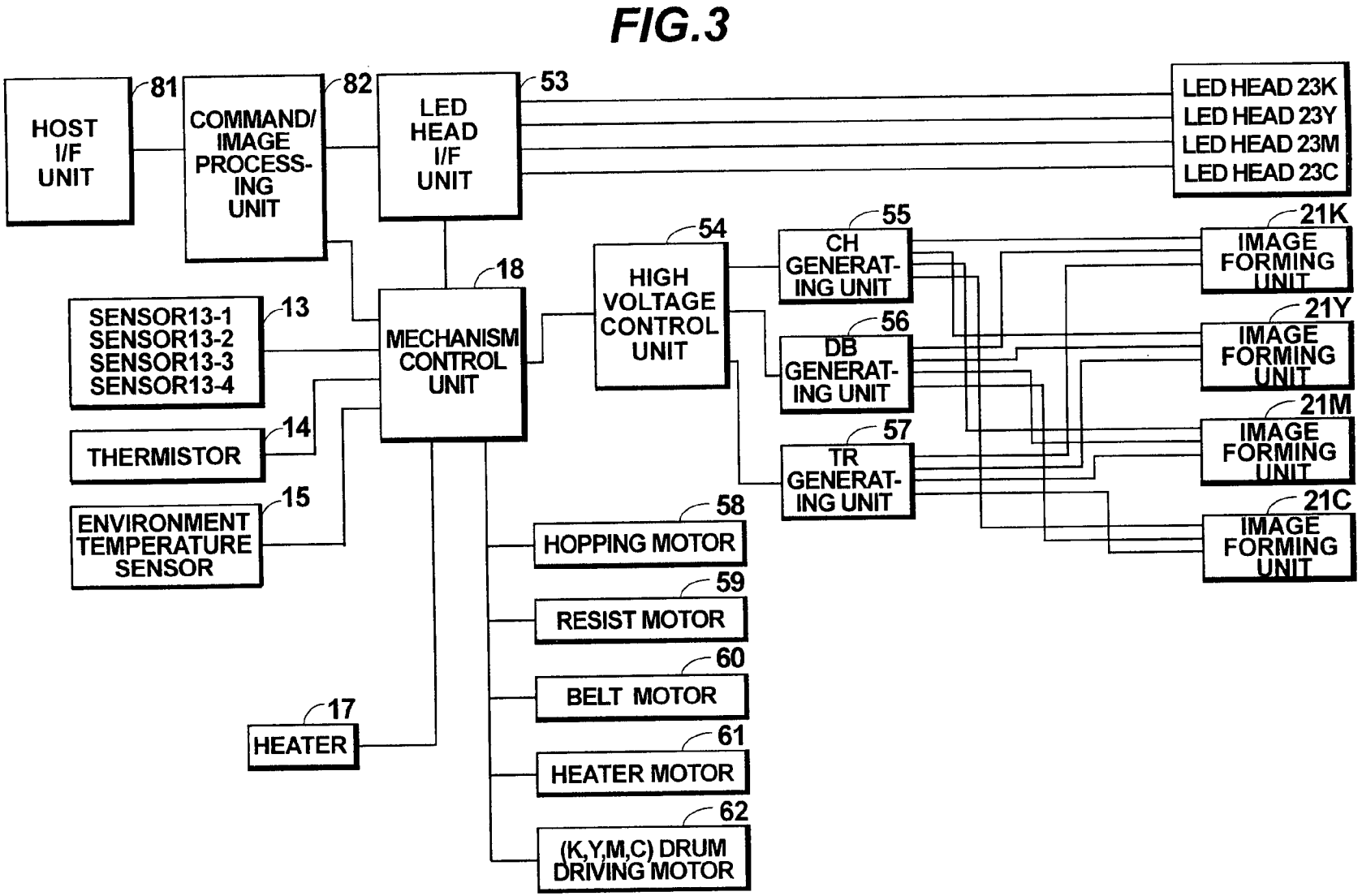
FIG. 3 is a block diagram of a control system of the invention.

Explanation regarding an outline of the print mechanism unit is finished in this manner. A control system of the invention will now be described in detail with reference to FIG. 3.

A host interface (I/F) unit 81 is a section for playing a role of an interface with an external apparatus, that is, a host computer.

A command/image processing unit 82 is a section for analyzing a print job received from the external apparatus, editing and developing it, and outputting bit map data and various control instructions.

An LED head interface (I/F) unit 53 is a section for sending the bit map data of one line outputted from the command/image processing unit 82 to the LED heads 23K, 23Y, 23M, and 23C.

As mentioned above, the LED heads 23K, 23Y, 23M, and 23C are sections for receiving the bit map data of one line from an LED head interface (I/F) unit 53, turning on the LEDs corresponding to the bit map data, and forming electrostatic latent images onto the surfaces of the photosensitive drums 3K, 3Y, 3M, and 3C.

A high voltage control unit 54 is a section for controlling generation of a charging voltage (CH), a developing bias voltage (DB), and a transfer voltage (TR) under the control of a mechanism control unit 18.

A CH generating unit 55 is a section for supplying the charging voltage (CH) to the image forming units 21K, 21Y, 21M, and 21C under the control of the high voltage control unit 54. The charging voltage (CH) is applied to the charging rollers 22K, 22Y, 22M, and 22C (FIG. 2).

A DB generating unit 56 is a section for supplying the developing bias voltage (DB) to the image forming units 21K, 21Y, 21M, and 21C under the control of the high voltage control unit 54. The developing bias voltage (DB) is applied to the developing rollers 24K, 24Y, 24M, and 24C (FIG. 2).

A TR generating unit 57 is a section for supplying the transfer voltage (TR) to the image forming units 21K, 21Y, 21M, and 21C under the control of the high voltage control unit 54. The transfer voltage (TR) is applied to the transfer rollers 28K, 28Y, 28M, and 28C (FIG. 2).

A hopping motor 58 is a motor for driving the hopping roller 36 (FIG. 2) under the control of the mechanism control unit 18.

A resist motor 59 is a motor for driving the resist roller 38 (FIG. 2) under the control of the mechanism control unit 18.

A heater motor 61 is a motor for driving the heat roller 41 (FIG. 2) under the control of the mechanism control unit 18.

Drum driving motors 62 (K, Y, M, C) are motors for driving the photosensitive drums 3K, 3Y, 3M, and 3C (FIG. 2) under the control of the mechanism control unit 18.

The sensors 13-1, 13-2, 13-3, and 13-4 are position sensors for detecting the position of the print medium during the printing step. Position detection signals of those sensors are sent to the mechanism control unit 18.

The thermistor 14 is a temperature sensor to detect a fixing temperature of the heat roller 41 (FIG. 2). The detection temperature is sent to the mechanism control unit 18.

An environment temperature sensor 15 is a sensor to detect a temperature in the apparatus.

A heater 17 is a heater to heat the heat roller 41.

The mechanism control unit 18 is a section for controlling the whole control system described above and has the following internal construction.

Figure 4:
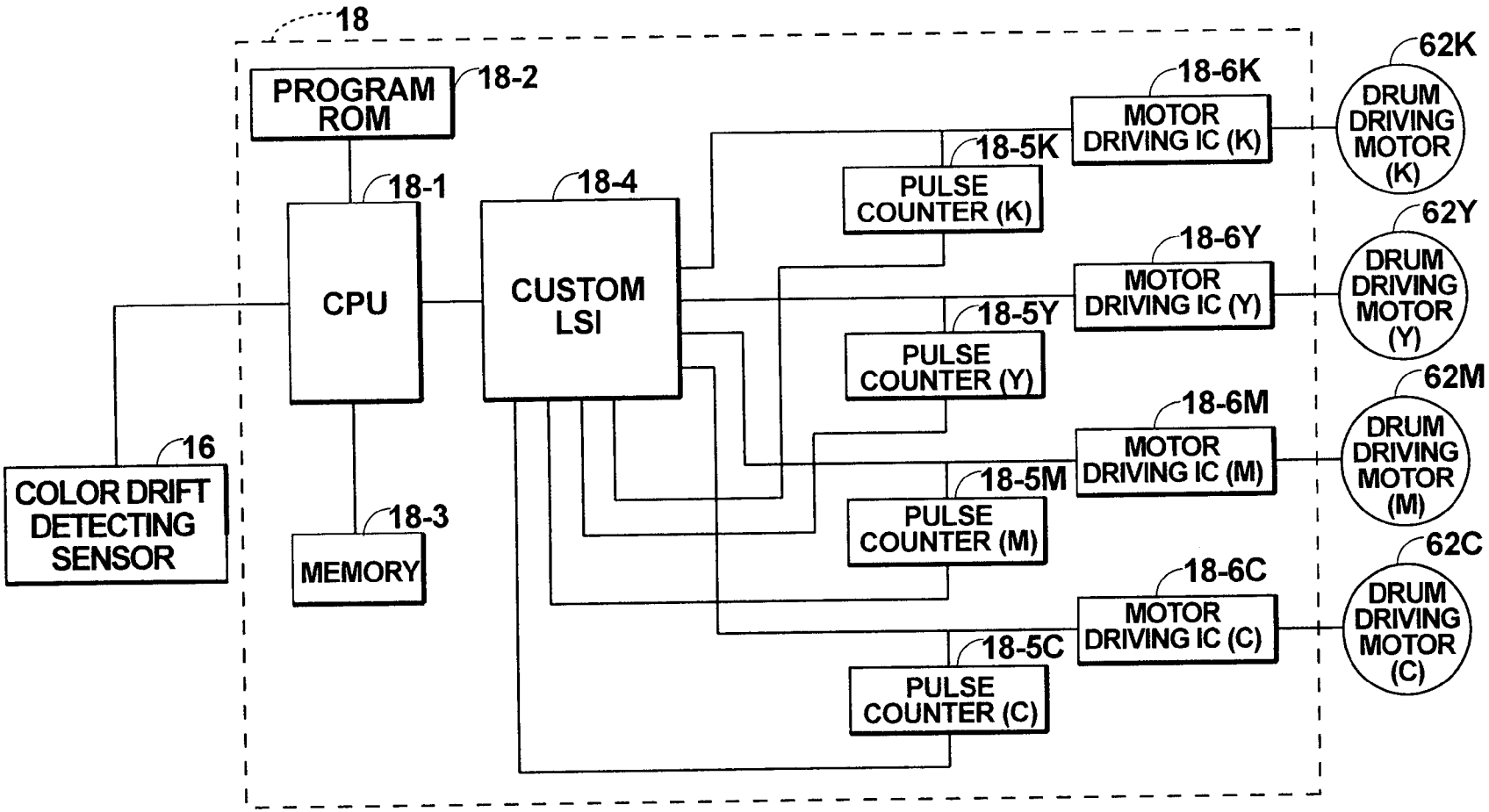
FIG. 4 is an internal constructional diagram of a mechanism control unit.

FIG. 4 is an internal constructional diagram of the mechanism control unit.

As shown in the diagram, the mechanism control unit 18 has: a CPU (Central Processing Unit) 18-1; a program ROM 18-2 in which a control program for executing control means has been stored; a memory 18-3 for storing data and the like necessary to execute the control means; and a custom LSI 18-4 for dividing the control system into four systems of K, Y, M, and C.

Further, the control system is divided every four colors from the custom LSI 18-4 and the drum driving motors 62K, 62Y, 62M, and 62C and motor driving ICs 18-6K, 18-6Y, 18-6M, and 18-6C for outputting driving pulses to the drum driving motors are connected to the divided control systems. Further, pulse counters 18-5K, 18-5Y, 18-5M, and 18-5C each for counting the number of driving pulses outputted from the motor driving ICs are arranged.

Figure 5B:
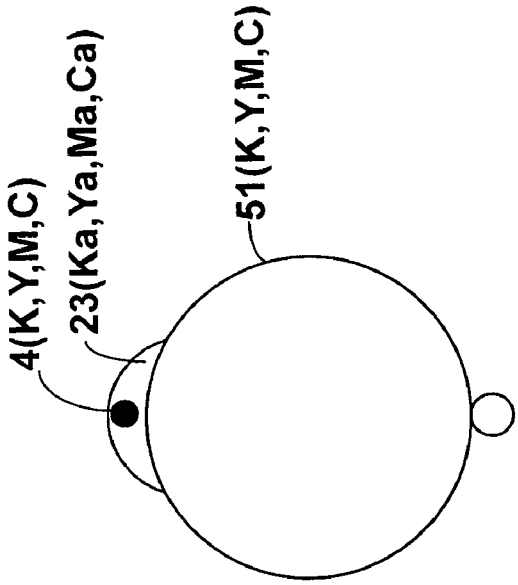
FIG. 5 is an explanatory diagram of marks and detecting units of the invention.
Figure 5A:
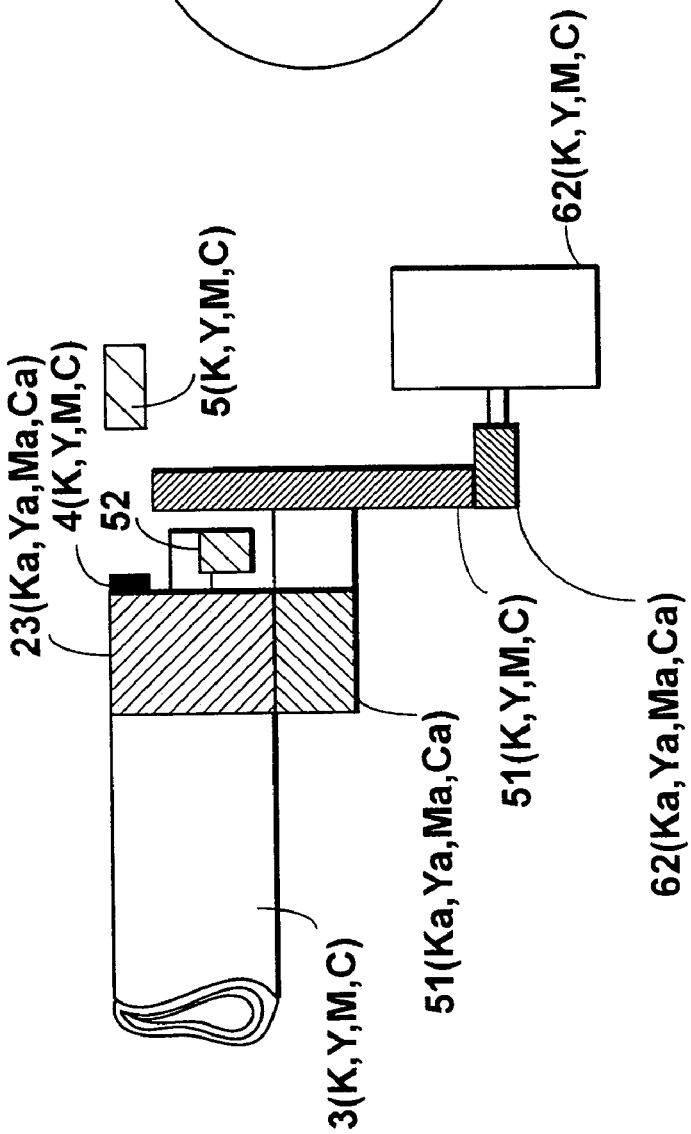

FIG. 5 is an explanatory diagram of drum gear/idle gear separating means.

Only the image forming unit 21K (FIG. 2) will be described here.

As shown in FIG. 5, a rotating force to drive the photosensitive drum 3K is transferred from the drum driving motor 62K to the photosensitive drum 3K through a drum motor gear 62Ka which is axially supported to a rotary shaft of the drum driving motor 62K, an idle gear 51K which is come into engagement with the drum motor gear 62Ka, the driving gear 9K (FIG. 1) which is axially supported to a rotary shaft of the idle gear 51K, and a photosensitive drum gear 23Ka that is axially supported to the photosensitive drum 3K. Since each of the image forming unit 21Y (FIG. 2), the image forming unit 21M (FIG. 2), and the image forming unit 21C (FIG. 2) is substantially similar to the image forming unit 21K (FIG. 2), their description is omitted here.

Drum gear/idle gear separating means 52 for releasing the engagement of the driving gear 9K and the photosensitive drum gear 23Ka is further provided. Thus, rotational phases of the photosensitive drum and the driving gear can be independently set. Since each of the image forming unit 21Y (FIG. 2), the image forming unit 21M (FIG. 2), and the image forming unit 21C (FIG. 2) is almost similar to that of the image forming unit 21K (FIG. 2), their explanation is omitted here.

Returning to FIG. 1, the belt roller 1 is a section for receiving a driving force of the belt driving unit 6 through the belt driving gear 7 and conveying the belt under the control of the control unit 10.

The belt 2 is a section which is conveyed in the state where it sandwiches a recording medium 100 together with the photosensitive drums 3 (K, Y, M, C).

While the photosensitive drums 3 (K, Y, M, C) are conveying the recording medium 100 in the state where they sandwich it together with the belt 2, the surfaces of the drums 3 are charged to a negative electric potential by a charging roller. A predetermined image is irradiated to the charged section by the LED head of each color, so that an electrostatic latent image is formed there. The electrostatic latent image is developed to a toner image by a developing unit. The toner image is transferred onto the recording medium by a transfer unit.

Ordinarily, in a multicolor image forming apparatus such as a color electrophotographic printer or the like, the photosensitive drums 3 (K, Y, M, C) for forming the toner images of K (black), Y (yellow), M (magenta), and C (cyan) are arranged in a line on the belt 1 at predetermined intervals. For example, as shown in the diagram, the photosensitive drums are arranged from the upstream in the sheet conveying direction toward its downstream in order of K, Y, M, C.

As already described in the paragraphs of "Related Background Art", in order to simultaneously start the rotation of those four photosensitive drums, simultaneously stop the rotation of them, and laminate the toner images of four colors of K, Y, M, and C to the same position on the sheet conveyed on the belt 2, the time when the light from the LED to form the image is irradiated onto the photosensitive drum 3K, photosensitive drum 3Y, photosensitive drum 3M, and photosensitive drum 3C has to be accurately set.

However, even if the irradiating time is accurately set as mentioned above, there is a case where a color drift occurs among the toner images of four colors of K, Y, M, and C due to the eccentricity or the like of the photosensitive drums. Since the rotational driving forces have been applied to the photosensitive drums 3 (K, Y, M, C) from the photosensitive drum driving units 8 (K, Y, M, C) through the photosensitive drum driving gears 9 (K, Y, M, C), the eccentricities of all of the photosensitive drums 3 (K, Y, M, C), the photosensitive drum driving gears 9 (K, Y, M, C), and the photosensitive drum driving units 8 (K, Y, M, C) can become factors of the color drift.

Periodicity occurs in the color drift since the photosensitive drums 3 (K, Y, M, C), the photosensitive drum driving gears 9 (K, Y, M, C), and the photosensitive drum driving units 8 (K, Y, M, C) are rotary members. To make the color drift most inconspicuous, it is necessary not only to accurately set the time when the images are irradiated onto the photosensitive drums 3K, 3Y, 3M, and 3C but also to accurately control the rotational phase differences among the photosensitive drums 3 (K, Y, M, C) (refer to JP-A-2000-187428). To satisfy such a requirement, the marks 4 (K, Y, M, C) are added to the photosensitive drums 3 (K, Y, M, C), respectively, and the reference mark detecting units 5 (K, Y, M, C) are arranged.

As shown in FIGS. 1 and 5, the marks 4 (K, Y, M, C) are constructed in such a manner that, for example, a metal film, a glass plate, or the like to reflect the light is adhered in one position on a circumference of a non-transfer section of each of the photosensitive drums 3 (K, Y, M, C). For example, the reference mark detecting units 5 (K, Y, M, C) are photodetecting sensors and arranged in non-rotating sections around the photosensitive drums 3 (K, Y, M, C) so as to irradiate the light to the marks 4 (K, Y, M, C) and receive the reflection light.

The control unit 10 is a CPU (Central Processing Unit) for controlling the whole apparatus. In the embodiment, particularly, the control unit 10 is a section for executing drum/belt drive starting procedure 10-1 (K, Y, M, C, V), drum/belt driving time calculating procedure 10-2 (K, Y, M, C, V), and drum/belt drive stopping procedure 10-3 (K, Y, M, C, V) in this order. In other words, the control unit 10 includes drum/belt drive starting portion, drum/belt driving time calculating portion and drum/belt drive stopping portion.

The drum/belt drive starting procedure 10-1 (K, Y, M, C, V) is procedure for driving the photosensitive drum driving units 8 (K, Y, M, C), simultaneously starting the rotation of the photosensitive drums 3 (K, Y, M, C), further, simultaneously driving the belt driving unit 6, and starting the conveyance of the belt 2. These procedures are control procedures of the control unit 10 which are formed when the CPU executes computer-readable programs which have previously been stored in a storing unit (not shown) in the apparatus.

The drum/belt driving time calculating procedure 10-2 (K, Y, M, C, V) is a procedure for setting the rotational drive stop time of a plurality of photosensitive drums (K, Y, M, C) and the conveyance drive stop time of the conveying belt 2 on the basis of detection results of the reference mark detecting units 5 (K, Y, M, C). These procedures are control procedures of the control unit 10 which are formed when the CPU executes the computer-readable programs which have previously been stored in the storing unit (not shown) in the apparatus.

The drum/belt drive stopping procedure 10-3 (K, Y, M, C, V) is a procedure for stopping the rotational drive of a plurality of photosensitive drums (K, Y, M, C) and the conveyance drive of the conveying belt 2 on the basis of calculation results of the drum/belt driving time calculating procedure 10-2 (K, Y, M, C, V). These procedures are control procedures of the control unit 10 which are formed when the CPU executes the computer-readable programs which have previously been stored in the storing unit (not shown) in the apparatus.

The position setting operation of the photosensitive drums in the embodiment 1 will now be described.

Figure 6B:
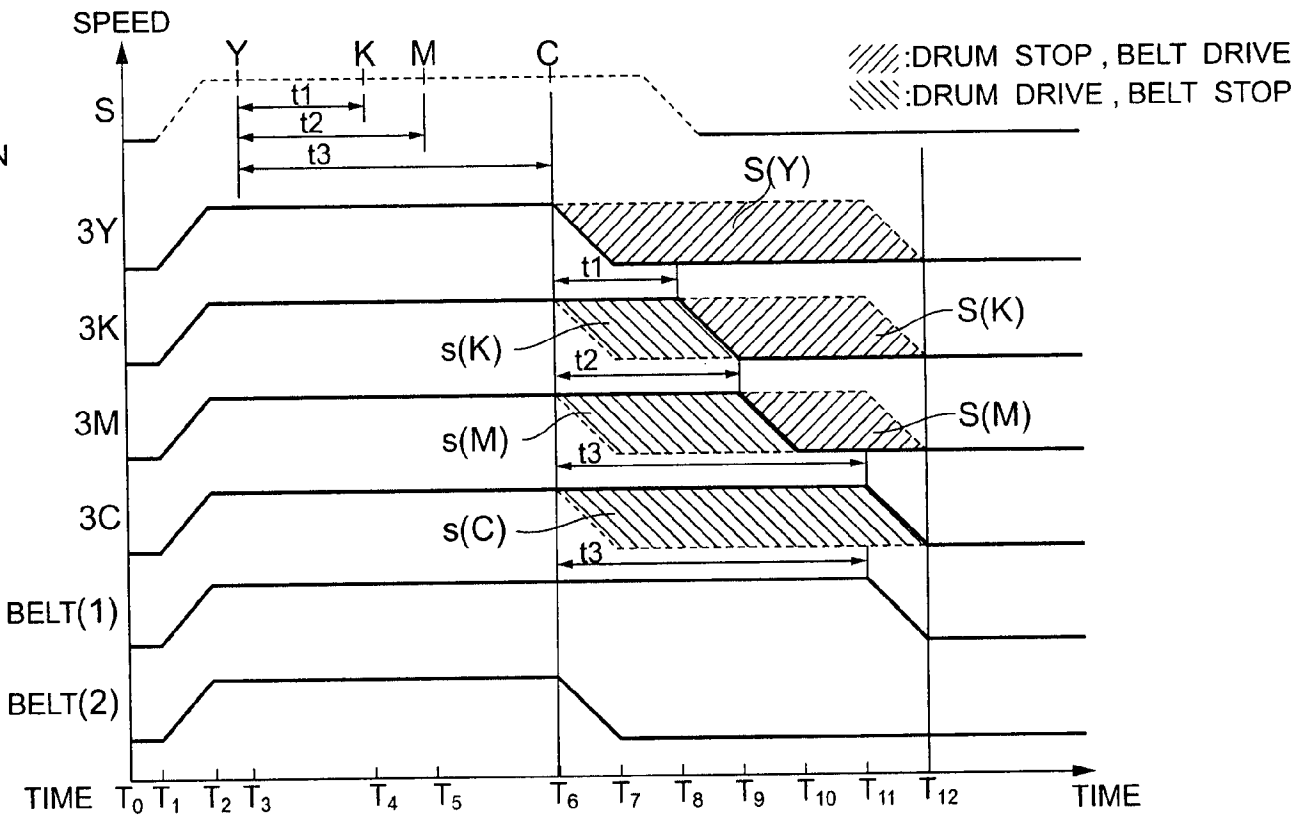
FIGS. 6A and 6B are explanatory diagrams (part 1) of a phase difference setting principle of the embodiment 1.
Figure 6A:
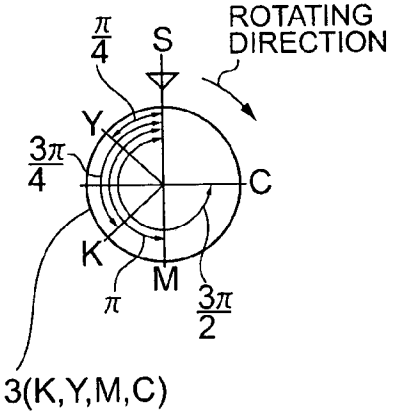

FIGS. 6A and 6B are explanatory diagrams (part 1) of a phase difference setting principle of the embodiment 1.

FIG. 6A is a diagram showing an example of phase differences of the photosensitive drums 3 (K, Y, M, C) (FIG. 1). In the diagram, a large circle of a solid line is a diagram showing the state where the phase differences of the four photosensitive drums 3 (K, Y, M, C) (FIG. 1) are shown on one circle in a lump. A point S indicates positions where the reference mark detecting units 5 (K, Y, M, C) (FIG. 1) are set. Y, K, M, and C on the circumference indicate phase lags of the marks 4 (Y, K, M, C) (FIG. 1) of the photosensitive drums 3 (Y, K, M, C) from the point S, respectively.

The diagrams show the case where the mark 4Y of the photosensitive drum 3Y is delayed from the point S by $\pi/4$, the mark 4K of the photosensitive drum 3K is delayed from the point S by $3\pi/4$, the mark 4M of the photosensitive drum 3M is delayed from the point S by $\pi$, and the mark 4C of the photosensitive drum 3C is delayed from the point S by $3\pi/2$, respectively.

FIG. 6B is a diagram showing a step of making the phase differences of the marks 4 (K, Y, M, C) coincident from the state of FIG. 6A. In the diagram, an axis of ordinate indicates rotational peripheral velocities (=conveying speeds of the belt) of the photosensitive drums 3 (Y, K, M, C) and an axis of abscissa indicates an elapsed time. In the diagram, in order from the top, S denotes detecting time of the marks 4 (Y, K, M, C) at the point S; 3Y a relation between the rotational peripheral velocity of the photosensitive drum 3Y and the elapsed time; 3K a relation between the rotational peripheral velocity of the photosensitive drum 3K and the elapsed time; 3M a relation between the rotational peripheral velocity of the photosensitive drum 3M and the elapsed time; and 3C a relation between the rotational peripheral velocity of the photosensitive drum 3C and the elapsed time. A belt (1) shows a relation between the conveying speed in the case where the belt has been stopped at the shortest elapsed time and the elapsed time. A belt (2) shows a relation between the conveying speed in the case where the belt has been stopped at the longest elapsed time and the elapsed time. The time shown at the bottom stage shows a change point of each diagram by the common time.

The operations of the photosensitive drums 3 (K, Y, M, C) and the belt (1) will now be described in accordance with the time shown at the bottom stage of FIG. 6B. After that, the operations of the photosensitive drums 3 (K, Y, M, C) and the belt (2) will be described. It is assumed that acceleration at the time of accelerating the photosensitive drums 3 (K, Y, M, C) and the belt (1, 2) and that at the time of decelerating them are equal.

Time T1:

By the drum/belt drive starting procedure 10-1 (K, Y, M, C, V), the rotation of the four photosensitive drums 3 (K, Y, M, C) is simultaneously started and the conveyance of the belt (1) is also simultaneously started.

Time T2:

After the rotational speeds of the four photosensitive drums 3 (K, Y, M, C) and the conveying speed of the belt (1) reach predetermined speeds, the rotation or the conveyance of the predetermined speed is continued.

Time T3:

The reference mark detecting unit 5Y (FIG. 1) detects the mark 4Y (FIG. 1). In FIG. 6A, this time is the time when the photosensitive drum 3Y finishes the rotation of $\pi/4$.

Time T4:

The reference mark detecting unit 5K detects the mark 4K (FIG. 1). In FIG. 6A, this time is the time when the photosensitive drum 3K finishes the rotation of $3/\pi/4$. A time interval from time T3 to time T4 is assumed to be t1.

Time T5:

The reference mark detecting unit 5M detects the mark 4M (FIG. 1). In FIG. 6A, this time is the time when the photosensitive drum 3M finishes the rotation of $\pi$. A time interval from time T3 to time T5 is assumed to be t2.

Time T6:

The reference mark detecting unit 5C detects the mark 4C (FIG. 1). In FIG. 6A, this time is the time when the photosensitive drum 3C finishes the rotation of $3\pi/2$. At the same time, the drum/belt drive stopping procedure 10-3Y (FIG. 1) starts the deceleration of the photosensitive drum 3Y. A time interval from time T3 to time T6 is assumed to be t3.

Time T7:

The photosensitive drum 3Y is stopped.

Time T8:

The drum/belt drive stopping procedure 10-3K (FIG. 1) starts the deceleration of the photosensitive drum 3K. A time interval from time T6 to time T8 is set to be equal to t1.

Time T9:

The drum/belt drive stopping procedure 10-3M (FIG. 1) starts the deceleration of the photosensitive drum 3M. A time interval from time T6 to time T9 is set to be equal to t2. The photosensitive drum 3K is stopped. The stop of the photosensitive drum 3K is not concerned with t2.

Time T10:

The photosensitive drum 3M is stopped.

Time T11:

The drum/belt drive stopping procedure 10-3C (FIG. 1) starts the deceleration of the photosensitive drum 3C. At the same time, the drum/belt drive stopping procedure 10-3V (FIG. 1) starts the deceleration of the belt (1). A time interval from time T6 to time T11 is set to be equal to t3.

Time T12:

The photosensitive drum 3C and the belt (1) are stopped.

By executing the procedures described above, the marks 4 (K, Y, M, C) are set to the same phase.

Rubbing between the photosensitive drums 3 (K, Y, M, C) and the belt (1) will now be described.

(1) The photosensitive drum 3Y and the belt (1) are in the rubbing state for the period of time from time T6 to time T12. A rubbing amount corresponds to an area S(Y) of a hatched region where oblique lines drop from the right side to the left side.

(2) The photosensitive drum 3K and the belt (1) are in the rubbing state for the period of time from time T8 to time T12. A rubbing amount corresponds to an area S(K) of a hatched region where oblique lines drop from the right side to the left side.

(3) The photosensitive drum 3M and the belt (1) are in the rubbing state for the period of time from time T9 to time T12. A rubbing amount corresponds to an area S(M) of a hatched region where oblique lines drop from the right side to the left side.

(4) The rubbing of the photosensitive drum 3C is equal to 0.

The operations of the photosensitive drums 3 (K, Y, M, C) and the belt (2) will now be described.

For the period of time from time T1 to time T6, since the operations are substantially similar to those of the photosensitive drums 3 (K, Y, M, C) and the belt (1), their description is omitted and the operations after time T6 will be explained.

Time T6:

The reference mark detecting unit 5C detects the mark 4C (FIG. 1). The drum/belt drive stopping procedure 10-3Y (FIG. 1) starts the deceleration of the photosensitive drum 3Y and the belt (2).

Time T7:

The photosensitive drum 3Y and the belt (2) are stopped.

Time T8:

The drum/belt drive stopping procedure 10-3K (FIG. 1) starts the deceleration of the photosensitive drum 3K. A time interval from time T6 to time T8 is set to be equal to t1.

Time T9:

The drum/belt drive stopping procedure 10-3M (FIG. 1) starts the deceleration of the photosensitive drum 3M. A time interval from time T6 to time T9 is set to be equal to t2. The photosensitive drum 3K is stopped. The stop of the photosensitive drum 3K is not concerned with t2.

Time T10:

The photosensitive drum 3M is stopped.

Time T11:

The drum/belt drive stopping procedure 10-3C (FIG. 1) starts the deceleration of the photosensitive drum 3C. A time interval from time T6 to time T11 is set to be equal to t3.

Time T12:

The photosensitive drum 3C is stopped.

By executing the procedures described above, the marks 4 (K, Y, M, C) are set to the same phase.

Rubbing between the photosensitive drums 3 (K, Y, M, C) and the belt (2) will now be described.

(5) The rubbing of the photosensitive drum 3Y is equal to 0.

(6) The photosensitive drum 3K and the belt (2) are in the rubbing state for the period of time from time T6 to time T9. A rubbing amount corresponds to an area s(K) of a hatched region where oblique lines drop from the left side to the right side.

(7) The photosensitive drum 3M and the belt (2) are in the rubbing state for the period of time from time T6 to time T10. A rubbing amount corresponds to an area s(M) of a hatched region where oblique lines drop from the left side to the right side.

(8) The photosensitive drum 3C and the belt (2) are in the rubbing state for the period of time from time T6 to time T12. A rubbing amount corresponds to an area s(C) of a hatched region where oblique lines drop from the left side to the right side.

A position setting method whereby, in the initial state, the photosensitive drums 3 (K, Y, M, C) having the phase differences shown in FIG. 6A are set to the same phase at the lowest limit rubbing amount will now be described.

Figure 7B:
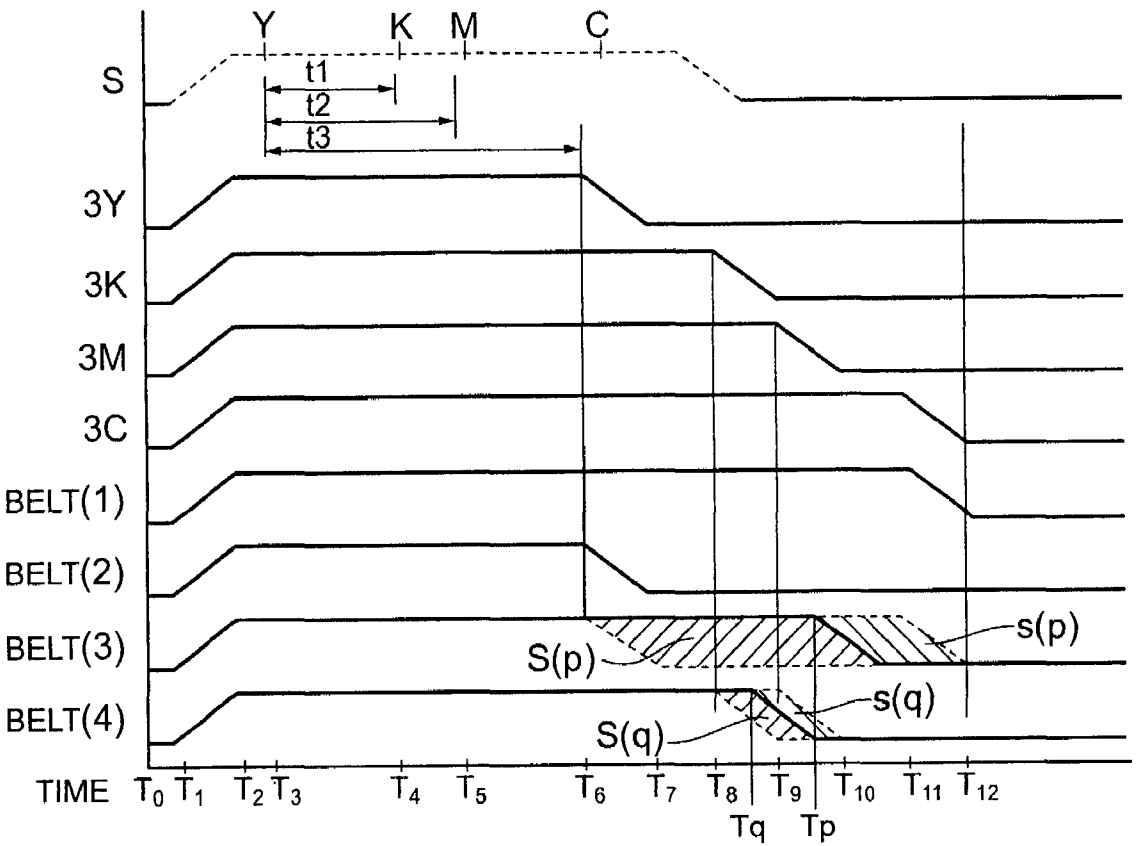
FIGS. 7A and 7B are explanatory diagrams (part 2) of the phase difference setting principle of the embodiment 1.
Figure 7A:
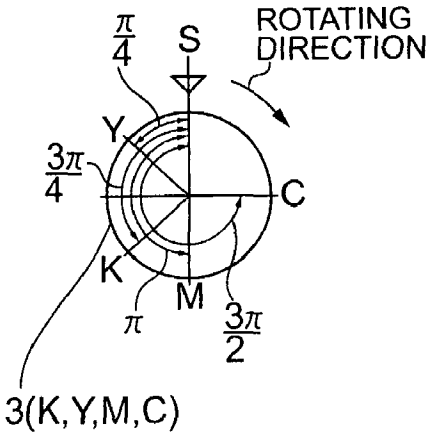

FIGS. 7A and 7B are explanatory diagrams (part 2) of the phase difference setting principle of the embodiment 1.

FIG. 7A is a diagram showing an example of the phase differences of the photosensitive drums 3 (K, Y, M, C) (FIG. 1). In the diagram, a large circle of a solid line is a diagram showing the state where the phase differences of the four photosensitive drums 3 (K, Y, M, C) (FIG. 1) are shown on one circle in a lump. The point S indicates the positions where the reference mark detecting units 5 (K, Y, M, C) (FIG. 1) are set. Y, K, M, and C on the circumference indicate phase lags of the marks 4 (Y, K, M, C) (FIG. 1) of the photosensitive drums 3 (Y, K, M, C) from the point S, respectively. This state is set to the same state shown in FIGS. 6A and 6B.

The diagrams show the case where the mark 4Y of the photosensitive drum 3Y is delayed from the point S by $\pi/4$, the mark 4K of the photosensitive drum 3K is delayed from the point S by $3\pi/4$, the mark 4M of the photosensitive drum 3M is delayed from the point S by $\pi$, and the mark 4C of the photosensitive drum 3C is delayed from the point S by $3\pi/2$, respectively.

FIG. 7B is a diagram showing a step of making the phase differences of the marks 4 (K, Y, M, C) coincident from the state of FIG. 7A. In the diagram, an axis of ordinate indicates the rotational peripheral velocities (=conveying speeds of the belt) of the photosensitive drums 3 (Y, K, M, C) and an axis of abscissa indicates the elapsed time. In the diagram, in order from the top, S denotes the detecting time of the marks 4 (Y, K, M, C) at the point S; 3Y the relation between the rotational peripheral velocity of the photosensitive drum 3Y and the elapsed time; 3K the relation between the rotational peripheral velocity of the photosensitive drum 3K and the elapsed time; 3M the relation between the rotational peripheral velocity of the photosensitive drum 3M and the elapsed time; and 3C the relation between the rotational peripheral velocity of the photosensitive drum 3C and the elapsed time. The belt (1) shows the relation between the conveying speed of the belt in the case where the belt has been stopped at the shortest elapsed time and the elapsed time. The belt (2) shows the relation between the conveying speed of the belt in the case where the belt has been stopped at the longest elapsed time and the elapsed time. A belt (3) shows a relation between the conveying speed in the case where the deceleration of the belt is started between the photosensitive drum whose deceleration has been started for the first time (assumed to be the photosensitive drum 3Y here) and the photosensitive drum whose deceleration has been started lastly (assumed to be the photosensitive drum 3C here) and the elapsed time. Among the remaining photosensitive drums excluding the photosensitive drum whose deceleration has been started for the first time (assumed to be the photosensitive drum 3Y here) and the photosensitive drum whose deceleration has been started lastly (assumed to be the photosensitive drum 3C here), a belt (4) shows a relation between the conveying speed in the case where the deceleration of the belt is started between the photosensitive drum whose deceleration has been started for the first time (assumed to be the photosensitive drum 3K here) and the photosensitive drum whose deceleration has been started lastly (assumed to be the photosensitive drum 3M here) and the elapsed time. The time shown at the bottom stage shows a change point of each diagram by the common time.

The relations of the photosensitive drums 3 (K, Y, M, C) and the belts (1) and (2) are substantially similar to those in FIGS. 6A and 6B already described above, their description is omitted. Only the operations of the belts (3) and (4) will now be described.

As shown in the diagrams, the belt (3) has started the deceleration at time Tp (one example) between the photosensitive drum whose deceleration has been started for the first time (assumed to be the photosensitive drum 3Y here) and the photosensitive drum whose deceleration has been started lastly (assumed to be the photosensitive drum 3C here). At this time, the rubbing amount between the belt (3) and the photosensitive drum 3Y corresponds to an area S(p) of a hatched region where oblique lines drop from the right side to the left side. The rubbing amount between the belt (3) and the photosensitive drum 3C corresponds to an area s(p) of a hatched region where oblique lines drop from the left side to the right side. Therefore, it will be understood that the sum of the area S(p) and the area s(p) is constant so long as time Tp exists between deceleration time T6 of the photosensitive drum 3Y whose deceleration has been started for the first time and deceleration time T11 of the photosensitive drum 3C whose deceleration has been started lastly. If time Tp is out of the range from deceleration time T6 and deceleration time T11, the sum of the area S(p) and the area s(p) increases.

The belt (4) has started the deceleration at time Tq (one example) between the photosensitive drum whose deceleration has been started for the first time (assumed to be the photosensitive drum 3K here) and the photosensitive drum whose deceleration has been started lastly (assumed to be the photosensitive drum 3M here) among the remaining photosensitive drums excluding the photosensitive drum whose deceleration has been started for the first time (assumed to be the photosensitive drum 3Y here) and the photosensitive drum whose deceleration has been started lastly (assumed to be the photosensitive drum 3C here). The rubbing amount between the belt (4) and the photosensitive drum 3K corresponds to an area S(q) of a hatched region where oblique lines drop from the right side to the left side. The rubbing amount between the belt (4) and the photosensitive drum 3M corresponds to an area s(q) of a hatched region where oblique lines drop from the left side to the right side. Therefore, it will be understood that the sum of the area S(q) and the area s(q) is constant so long as time Tq exists between deceleration time T8 of the photosensitive drum 3K whose deceleration has been started for the first time and deceleration time T9 of the photosensitive drum 3M whose deceleration has been started lastly in the state where the photosensitive drums 3Y and 3C are excluded. If time Tq is out of the range from deceleration time T8 and deceleration time T9, the sum of the area S(q) and the area s(q) increases.

From the results described above, it will be understood that by making the deceleration time of the belt 2 (FIG. 1) coincide with that of the belt (3) in the above description, the rubbing amount is minimized and the phase differences among a plurality of rotary drums can be set.

Although the embodiment has been described above by limiting to the case where the number of photosensitive drums is equal to 4, the invention is not limited to such an example.

That is, if the number of photosensitive drums is larger than 4, in the state where the photosensitive drum whose deceleration time is the earliest and the photosensitive drum whose deceleration time is the latest are excluded, the photosensitive drum of the second earliest deceleration time and the photosensitive drum of the second latest deceleration time are selected. Further, in the state where the selected two photosensitive drums are excluded, the next photosensitive drums are successively selected in a manner similar to the above. It is sufficient that the deceleration time of the belt is set to timing between the deceleration time of the last two remaining photosensitive drums (the case where three photosensitive drums remain is also included).

As described above, by further adding the step of stopping the belt while the photosensitive drums are rotated, the time interval during which the photosensitive drum and the belt enter the rubbing state can be further reduced. Therefore, the decrease in life of both of the belt and the photosensitive drum due to the rubbing between them can be reduced and, further, the occurrence of the deflection in the belt can be prevented. Thus, such an effect that an output image with the small color drift can be obtained.

To reduce the costs of the belt driving unit, a torque which is needed by a motor of the belt driving unit can be decreased. However, in the case where each photosensitive drum is stopped with the time difference as in the embodiment, if the motor of the belt driving unit is stopped in the state where the number of stopped photosensitive drum is small, particularly, in accordance with the stop of the driving of the photosensitive drum which is stopped first, a frictional load occurring since the belt is conveyed in the state where the photosensitive drum is stopped and come into contact with the belt can be distributed to the drum motor of each photosensitive drum driving unit. The state where only the motor of the belt driving unit is set to the torque which is fairly higher than the torque necessary in the normal print mode can be lightened.

In this case, it is possible to make the torque distribution in consideration of the frictional load distributed to the drum motor of each photosensitive drum. In the case where the medium serving as a load is conveyed to a position between the belt and the photosensitive drum by the printing operation, print data can be printed up to the medium of a high load as compared with the case where only the motor of the belt driving unit can endure the high load.

Embodiment 2

In the embodiment 2, averaging of friction of the photosensitive drums is realized by sequentially changing the photosensitive drum serving as a reference of the phase difference setting. Its details will be described hereinbelow.

Since a construction of the embodiment 2 is substantially similar to that of the embodiment 1, its explanation is omitted and the phase difference setting operation of the photosensitive drums in the embodiment 2 will be described.

Figure 8A:
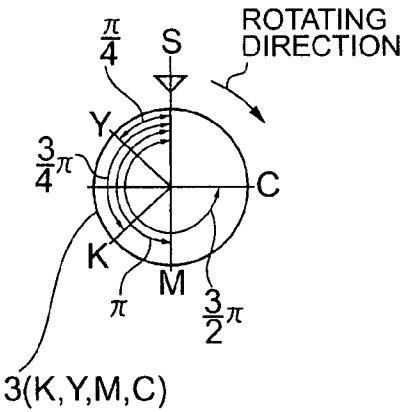
FIGS. 8A and 8B are explanatory diagrams of a phase difference setting principle of an embodiment 2.
Figure 8B:
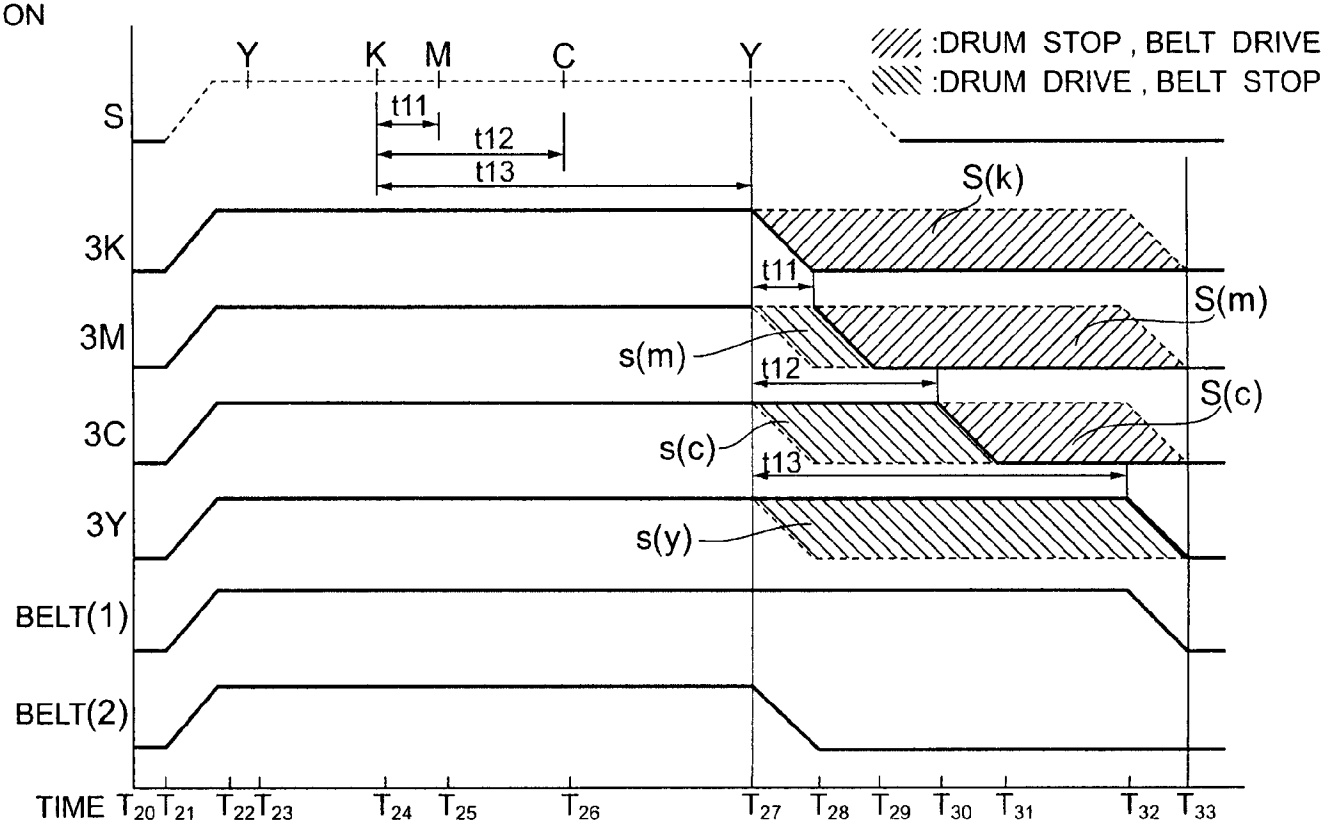

FIGS. 8A and 8B are explanatory diagrams of a phase difference setting principle of the embodiment 2.

FIG. 8A is a diagram showing an example of the phase differences of the photosensitive drums 3 (K, Y, M, C) (FIG. 1). In the diagram, a large circle of a solid line is a diagram showing the state where the phase differences of the four photosensitive drums 3 (K, Y, M, C) (FIG. 1) are shown on one circle in a lump. The point S indicates the positions where the reference mark detecting units 5 (K, Y, M, C) (FIG. 1) are set. Y, K, M, and C on the circumference indicate phase lags of the marks 4 (Y, K, M, C) (FIG. 1) of the photosensitive drums 3 (Y, K, M, C) from the point S, respectively.

The diagrams show the case where the mark 4Y of the photosensitive drum 3Y is delayed from the point S by $\pi/4$, the mark 4K of the photosensitive drum 3K is delayed from the point S by $3\pi/4$, the mark 4M of the photosensitive drum 3M is delayed from the point S by $\pi$, and the mark 4C of the photosensitive drum 3C is delayed from the point S by $3\pi/2$, respectively. This state is set to the same state in FIGS. 6A and 6B.

FIG. 8B is a diagram showing the step of making the phase differences of the marks 4 (K, Y, M, C) coincident from the state of FIG. 8A. In the diagram, an axis of ordinate indicates the rotational peripheral velocities (=conveying speeds of the belt) of the photosensitive drums 3 (Y, K, M, C) and an axis of abscissa indicates the elapsed time. In the diagram, in order from the top, S denotes the detecting time of the marks 4 (Y, K, M, C) at the point S; 3K the relation between the rotational peripheral velocity of the photosensitive drum 3K and the elapsed time; 3M the relation between the rotational peripheral velocity of the photosensitive drum 3M and the elapsed time; 3C the relation between the rotational peripheral velocity of the photosensitive drum 3C and the elapsed time; and 3Y the relation between the rotational peripheral velocity of the photosensitive drum 3Y and the elapsed time. The belt (1) shows the relation between the conveying speed in the case where the belt has been stopped at the shortest elapsed time and the elapsed time. The belt (2) shows the relation between the conveying speed in the case where the belt has been stopped at the longest elapsed time and the elapsed time. The time shown at the bottom stage shows the change point of each diagram by the common time.

The operations of the photosensitive drums 3 (K, Y, M, C) and the belt (1) will now be described in accordance with the time shown at the bottom stage of FIG. 8B. It is assumed that acceleration at the time of accelerating the photosensitive drums 3 (K, Y, M, C) and the belt (1, 2) and that at the time of decelerating them are equal.

Time T21:

By the drum/belt drive starting procedure 10-1 (K, Y, M, C, V), the rotation of the four photosensitive drums 3 (K, Y, M, C) is simultaneously started and the conveyance of the belt (1) is also simultaneously started.

Time T22:

After the rotational speeds of the four photosensitive drums 3 (K, Y, M, C) and the conveying speed of the belt (1) reach predetermined speeds, the rotation or the conveyance of the predetermined speed is continued.

Time T23:

The reference mark detecting unit 5Y (FIG. 1) detects the mark 4Y (FIG. 1). In FIG. 8A, this time is the time when the photosensitive drum 3Y finishes the rotation of $\pi/4$.

Time T24:

The reference mark detecting unit 5K detects the mark 4K (FIG. 1). In FIG. 8A, this time is the time when the photosensitive drum 3K finishes the rotation of $3\pi/4$.

Time T25:

The reference mark detecting unit 5M detects the mark 4M (FIG. 1). In FIG. 8A, this time is the time when the photosensitive drum 3M finishes the rotation of $\pi$. A time interval from time T24 to time T25 is assumed to be t11.

Time T26:

The reference mark detecting unit 5C detects the mark 4C (FIG. 1). In FIG. 8A, this time is the time when the photosensitive drum 3C finishes the rotation of $3\pi/2$. A time interval from time T24 to time T26 is assumed to be t12.

Time T27:

The reference mark detecting unit 5C detects the mark 4Y (FIG. 1) again. In FIG. 8A, this time is the time when the photosensitive drum 3Y further finishes the rotation of $2\pi$ from time T23. At the same time, the drum/belt drive stopping procedure 10-3K (FIG. 1) starts the deceleration of the photosensitive drum 3K. A time interval from time T24 to time T27 is set to be equal to t13.

Time T28:

The drum/belt drive stopping procedure 10-3M (FIG. 1) starts the deceleration of the photosensitive drum 3M. A time interval from time T27 to time T28 is set to be equal to t11. The photosensitive drum 3K is stopped here. The stop of the photosensitive drum 3K is not concerned with t11.

Time T29:

The photosensitive drum 3M is stopped.

Time T30:

The drum/belt drive stopping procedure 10-3C (FIG. 1) starts the deceleration of the photosensitive drum 3C. A time interval from time T27 to time T30 is set to be equal to t12.

Time T31:

The photosensitive drum 3C is stopped.

Time T32:

The drum/belt drive stopping procedure 10-3Y (FIG. 1) starts the deceleration of the photosensitive drum 3Y. At the same time, the drum/belt drive stopping procedure 10-3V (FIG. 1) starts the deceleration of the belt (1). A time interval from time T27 to time T32 is set to be equal to t13.

Time T33:

The photosensitive drum 3Y and the belt (1) are stopped.

By executing the procedures described above, the marks 4 (K, Y, M, C) are set to the same phase.

Rubbing between the photosensitive drums 3 (K, Y, M, C) and the belt (1) will now be described.

(11) The photosensitive drum 3K and the belt (1) are in the rubbing state for the period of time from time T27 to time T33. A rubbing amount corresponds to an area S(k) of a hatched region where oblique lines drop from the right side to the left side.

(12) The photosensitive drum 3M and the belt (1) are in the rubbing state for the period of time from time T28 to time T33. A rubbing amount corresponds to an area S(m) of a hatched region where oblique lines drop from the right side to the left side.

(13) The photosensitive drum 3C and the belt (1) are in the rubbing state for the period of time from time T30 to time T33. A rubbing amount corresponds to an area S(c) of a hatched region where oblique lines drop from the right side to the left side.

(14) The rubbing of the photosensitive drum 3Y is equal to 0.

The operations of the photosensitive drums 3 (K, Y, M, C) and the belt (2) will now be described.

For the period of time from time T21 to time T27, since the operations are substantially similar to those of the photosensitive drums 3 (K, Y, M, C) and the belt (1), their description is omitted and the operations after time T27 will be explained.

Time T27:

The reference mark detecting unit 5Y detects the mark 4Y (FIG. 1) again. The drum/belt drive stopping procedure 10-3K (FIG. 1) starts the deceleration of the photosensitive drum 3K and the belt (2).

Time T28:

The photosensitive drum 3K and the belt (2) are stopped. At this time, the drum/belt drive stopping procedure 10-3M (FIG. 1) starts the deceleration of the photosensitive drum 3M. A time interval from time T27 to time T28 is set to be equal to t11

Time T29:

The photosensitive drum 3M is stopped.

Time T30:

The drum/belt drive stopping procedure 10-3C (FIG. 1) starts the deceleration of the photosensitive drum 3C. A time interval from time T27 to time T30 is set to be equal to t12.

Time T31:

The photosensitive drum 3C is stopped.

Time T32:

The drum/belt drive stopping procedure 10-3Y (FIG. 1) starts the deceleration of the photosensitive drum 3Y. A time interval from time T27 to time T32 is set to be equal to t13.

Time T33:

The photosensitive drum 3Y is stopped.

By executing the procedures described above, the marks 4 (K, Y, M, C) are set to the same phase.

Rubbing between the photosensitive drums 3 (K, Y, M, C) and the belt (2) will now be described.

(15) The rubbing of the photosensitive drum 3K is equal to 0.

(16) The photosensitive drum 3M and the belt (2) are in the rubbing state for the period of time from time T27 to time T29. A rubbing amount corresponds to an area s(m) of a hatched region where oblique lines drop from the left side to the right side.

(17) The photosensitive drum 3C and the belt (2) are in the rubbing state for the period of time from time T27 to time T31. A rubbing amount corresponds to an area s(c) of a hatched region where oblique lines drop from the left side to the right side.

(18) The photosensitive drum 3Y and the belt (2) are in the rubbing state for the period of time from time T27 to time T33. A rubbing amount corresponds to an area s(y) of a hatched region where oblique lines drop from the left side to the right side.

It should be noted here to the following points.

As will be understood from FIGS. 6A and 6B, in the embodiment 1, the time interval during which the photosensitive drum 3Y is rubbed with the belt in the drum stop state is the longest among those of the four photosensitive drums, and the time interval during which the photosensitive drum 3C races in the belt stop state is the longest among those of the four photosensitive drums. As will be understood from FIGS. 8A and 8B, in the embodiment 2, the time interval during which the photosensitive drum 3K is rubbed with the belt in the drum stop state is the longest among those of the four photosensitive drums, and the time interval during which the photosensitive drum 3Y races in the belt stop state is the longest among those of the four photosensitive drums.

That is, by changing the photosensitive drum serving as a reference for setting the phase differences, the photosensitive drum in which the time interval during which it is rubbed with the belt in the drum stop state is long and the photosensitive drum in which the time interval during which it races in the belt stop state is long can be changed. The function of changing the photosensitive drum serving as a reference can be easily realized by a method whereby the operator sets the image forming apparatus into the drum/belt driving time calculating procedure 10-2 (K, Y, M, C, V) at the starting time point of the operation of the image forming apparatus.

As described above, in the embodiment 2, by sequentially changing the photosensitive drum serving as a reference for setting the phase differences, the abrasion of the photosensitive drums can be averaged, so that such an effect that the life of the image forming apparatus can be extended is obtained.

Embodiment 3

From FIGS. 6A and 6B described in the embodiment 1 and FIGS. 8A and 8B described in the embodiment 2, it will be understood that the photosensitive drum in which the time during which it is rubbed with the belt in the drum stop state is long is the photosensitive drum serving as a reference for setting the phase differences. That is, in the embodiment 1, it is the photosensitive drum 3Y and, in the embodiment 2, it is the photosensitive drum 3K. In those photosensitive drums, since only a part on the circumference of the drum is rubbed, they can become factors of promoting the eccentricity of the photosensitive drum. In the embodiment, therefore, the case where the photosensitive drum whose number of using times (the number of rotating times) is large becomes the reference for setting the phase differences is excluded and it is enabled that the photosensitive drum whose number of using times (the number of rotating times) is smallest is selected as a reference for setting the phase differences.

Figure 9:
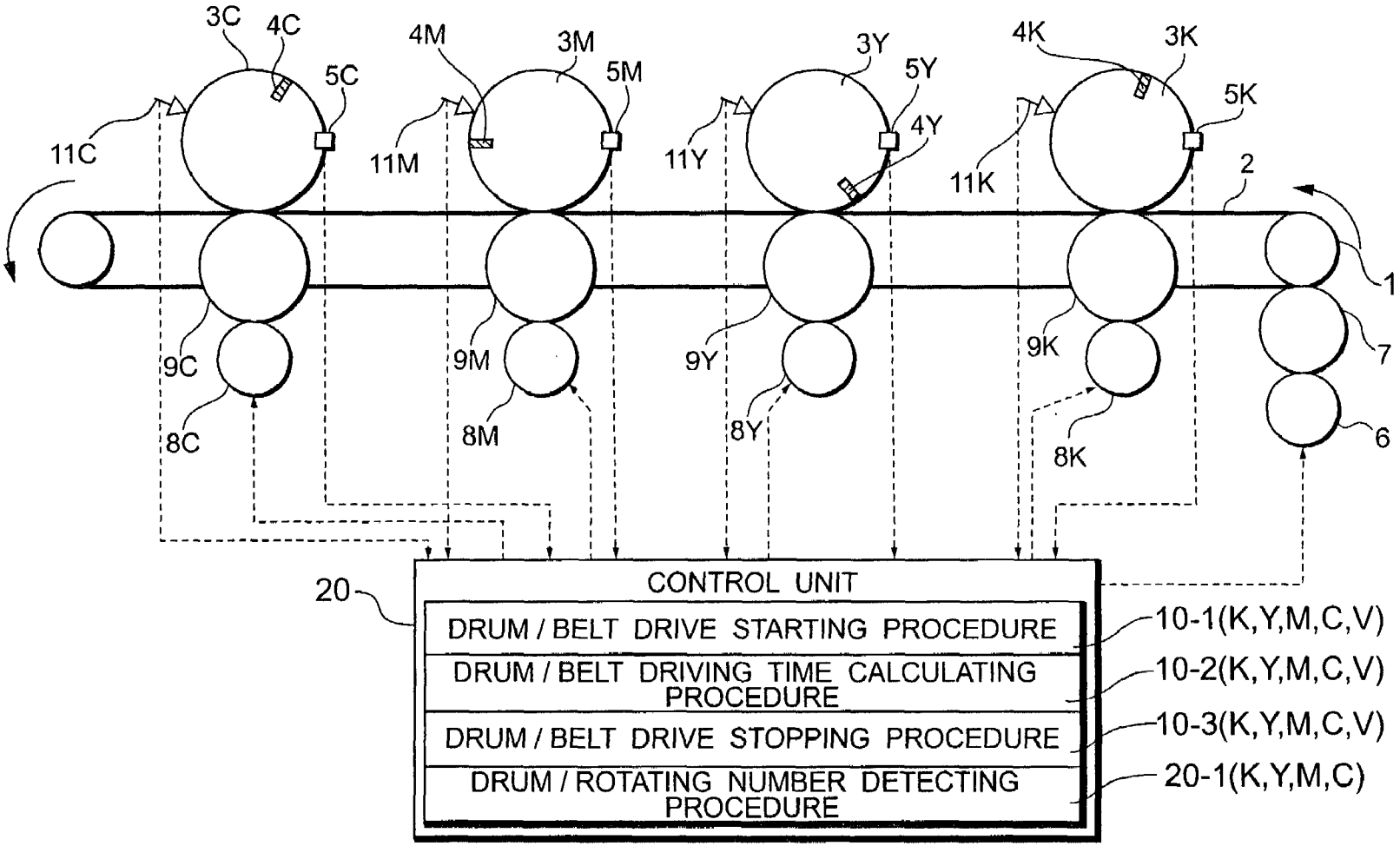
FIG. 9 is a block diagram of a construction of an embodiment 3.

FIG. 9 is a block diagram of a construction of an embodiment 3.

As shown in the diagram, an image forming apparatus according to the embodiment 3 is constructed by: the belt roller 1; the belt 2; the photosensitive drums 3 (K, Y, M, C); the marks 4 (K, Y, M, C); the reference mark detecting units 5 (K, Y, M, C); the belt driving unit 6; the belt driving gear 7; the photosensitive drum driving units 8 (K, Y, M, C); the photosensitive drum driving gears 9 (K, Y, M, C); rotating number counters 11 (K, Y, M, C); and a control unit 20. Only sections different from those in the construction of the embodiment 1 will be described hereinbelow. Sections similar to those in the embodiment 1 are designated by the same reference numerals as those in the embodiment 1.

Each of the rotating number counters 11 (K, Y, M, C) is a rotating number amount measuring section for counting the number of rotating times of each photosensitive drum 3 every time each reference mark detecting unit 5 detects each mark 4 and holding a count value as an accumulated number of rotating times.

The control unit 20 is a CPU (Central Processing Unit) for controlling the whole apparatus. In the embodiment, particularly, the control unit 20 is a section for executing the drum/belt drive starting procedure 10-1 (K, Y, M, C, V), the drum/belt driving time calculating procedure 10-2 (K, Y, M, C, V), the drum/belt drive stopping procedure 10-3 (K, Y, M, C, V), and drum rotating number detecting procedure 20-1 (K, Y, M, C), respectively. In other words, the control unit 20 includes drum/belt drive starting portion, drum/belt driving time calculating portion, drum/belt drive stopping portion and drum rotating number detecting portion.

The drum rotating number detecting procedure 20-1 (K, Y, M, C) is a procedure for individually monitoring the rotating number counters 11 (K, Y, M, C), obtaining the accumulated number of rotating times with respect to each of the photosensitive drums 3 (K, Y, M, C), and selecting the photosensitive drum whose accumulated number of rotating times is the smallest. These procedures are control procedures of the control unit 20 which are formed when the CPU executes the computer-readable programs which have previously been stored in the storing unit (not shown) in the apparatus.

Since other constructing sections and control procedures are similar to those in the embodiment 1, their description is omitted.

In the embodiment 3, by the above construction, the photosensitive drum whose accumulated number of rotating times is the smallest is selected as a photosensitive drum in which the earliest rotational drive stop time is set and the rotational drive stop time can be set. Thus, the eccentricity of the photosensitive drums can be lightened and such an effect that an output image with a small color drift can be obtained is derived.

Embodiment 4

The embodiments 1 to 3 have been described on the assumption that the peripheral velocity in the stationary state of the photosensitive drum and the conveying speed in the stationary state of the belt are equal. Therefore, it is presumed that the rubbing between both of them occurs when one of them is stopped. In an embodiment 4, the speeds (the peripheral velocity and the conveying speed) in the stationary state of both of them can be arbitrarily changed. By this construction, the relative speed between both of them is reduced and an adverse influence by the rubbing is decreased.

Figure 10:
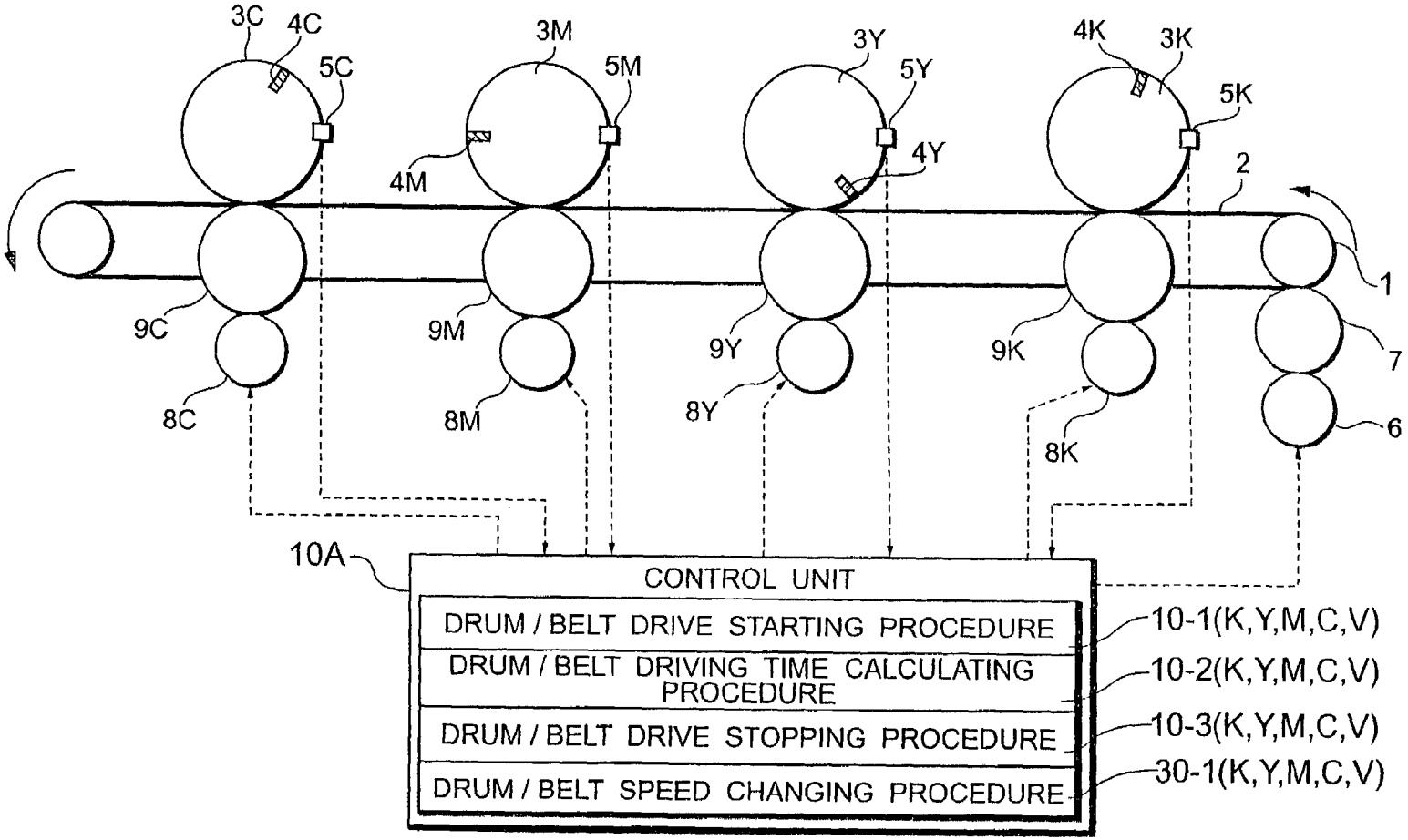
FIG. 10 is a block diagram of a construction of an embodiment 4.

FIG. 10 is a block diagram of a construction of the embodiment 4.

As shown in the diagram, an image forming apparatus according to the embodiment 4 is constructed by: the belt roller 1; the belt 2; the photosensitive drums 3 (K, Y, M, C); the marks 4 (K, Y, M, C); the reference mark detecting units 5 (K, Y, M, C); the belt driving unit 6; the belt driving gear 7; the photosensitive drum driving units 8 (K, Y, M, C); the photosensitive drum driving gears 9 (K, Y, M, C); and a control unit 10A.

The control unit 10A is a CPU (Central Processing Unit) for controlling the whole apparatus. In the embodiment, particularly, the control unit 10A is a section for executing the drum/belt drive starting procedure 10-1 (K, Y, M, C, V), the drum/belt driving time calculating procedure 10-2 (K, Y, M, C, V), the drum/belt drive stopping procedure 10-3 (K, Y, M, C, V), and drum/belt speed changing procedure 30-1 (K, Y, M, C, V), respectively. In other words, the control unit 10A includes drum/belt drive starting portion, drum/belt driving time calculating portion, drum/belt drive stopping portion and drum/belt speed changing portion.

Only sections different from those in the construction of the embodiment 1 will be described hereinbelow. Sections similar to those in the embodiment 1 are designated by the same reference numerals as those in the embodiment 1.

The drum/belt speed changing procedure 30-1 (K, Y, M, C, V) is a procedure for changing the peripheral velocity of each of a plurality of photosensitive drums (K, Y, M, C) and the conveying speed of the belt on the basis of the rotational drive stop time of each of the plurality of photosensitive drums (K, Y, M, C) and the conveyance drive stop time of the belt 2 which have been set by the drum/belt driving time calculating procedure 10-2 (K, Y, M, C, V) on the basis of the detection results of the reference mark detecting units 5 (K, Y, M, C), respectively. Those procedures are control procedures of the control unit 10A which are formed when the CPU executes the computer-readable programs which have previously been stored in the storing unit (not shown) in the apparatus. Since other constructing sections and control procedures are similar to those in the embodiment 1, their description is omitted.

The phase difference setting operation of the photosensitive drums in the embodiment 4 will now be described.

Figure 11B:
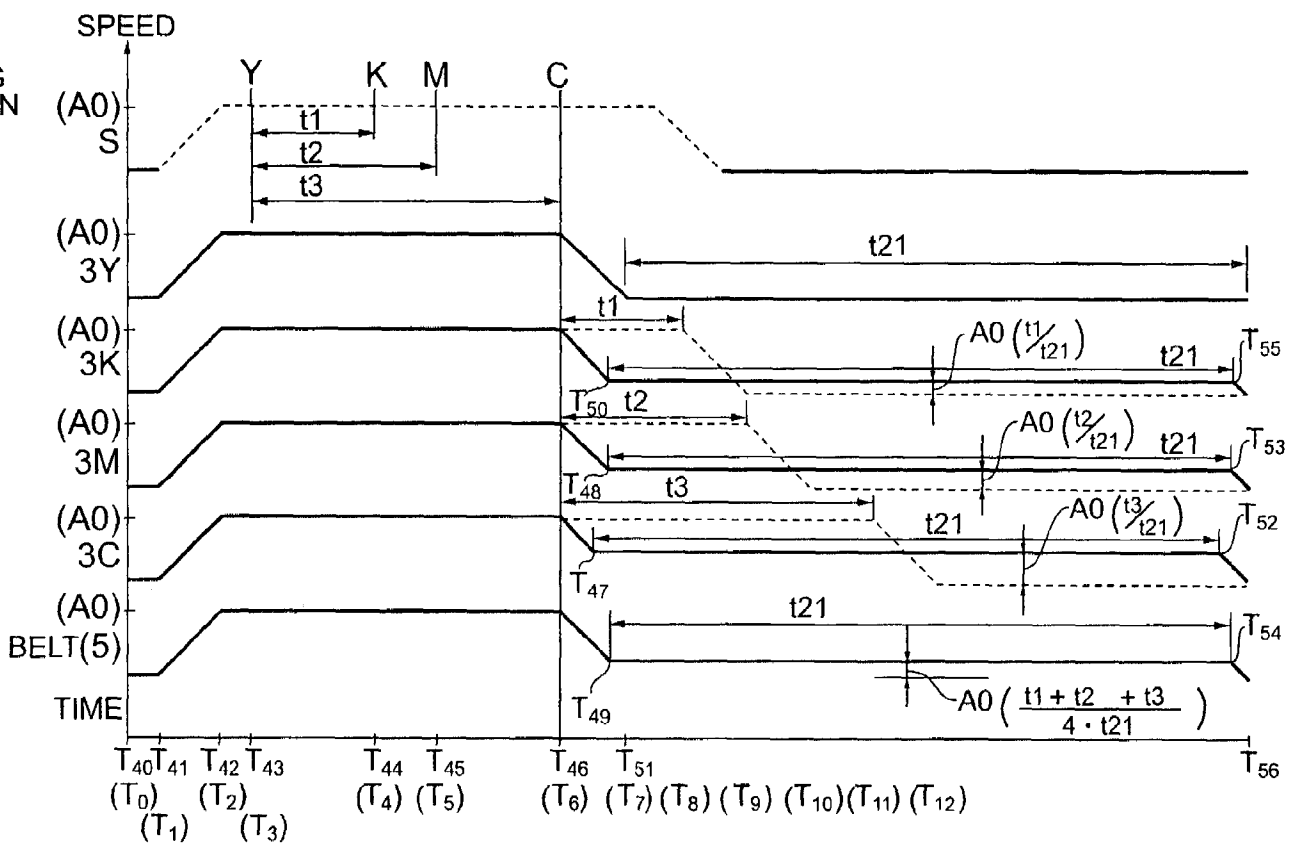
FIGS. 11A and 11B are explanatory diagrams of a phase difference setting principle of the embodiment 4.
Figure 11A:
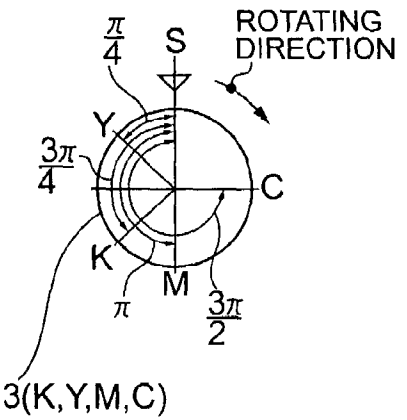

FIGS. 11A and 11B are explanatory diagrams of a phase difference setting principle of the embodiment 4.

FIG. 11A is a diagram showing an example of the phase differences of the photosensitive drums 3 (K, Y, M, C) (FIG. 10). In the diagram, a large circle of a solid line is a diagram showing the state where the phase differences of the four photosensitive drums 3 (K, Y, M, C) (FIG. 10) are shown on one circle in a lump. The point S indicates the positions where the reference mark detecting units 5 (K, Y, M, C) (FIG. 10) are set. Y, K, M, and C on the circumference indicate phase lags of the marks 4 (Y, K, M, C) (FIG. 10) of the photosensitive drums 3 (Y, K, M, C) from the point S, respectively.

The diagrams show the case where the mark 4Y of the photosensitive drum 3Y is delayed from the point S by $\pi/4$, the mark 4K of the photosensitive drum 3K is delayed from the point S by $3\pi/4$, the mark 4M of the photosensitive drum 3M is delayed from the point S by $\pi$, and the mark 4C of the photosensitive drum 3C is delayed from the point S by $3\pi/2$, respectively. This state is set to the same state in FIGS. 6A and 6B.

FIG. 11B is a diagram showing the step of making the phase differences of the marks 4 (K, Y, M, C) coincident from the state of FIG. 11A. In the diagram, an axis of ordinate indicates the rotational peripheral velocities (=conveying speeds of the belt) of the photosensitive drums 3 (Y, K, M, C) and an axis of abscissa indicates the elapsed time. In the diagram, in order from the top, S denotes the detecting time of the marks 4 (K, Y, M, C) at the point S; 3Y the relation between the rotational peripheral velocity of the photosensitive drum 3Y and the elapsed time. Further, a broken line indicates the calculation result of the drum/belt driving time calculating procedure 10-2Y (the same as that in the embodiment 1).

Reference numeral 3K denotes the relation between the rotational peripheral velocity of the photosensitive drum 3K and the elapsed time and, further, a broken line indicates the calculation result of the drum/belt driving time calculating procedure 10-2K (the same as that in the embodiment 1). Reference numeral 3M denotes the relation between the rotational peripheral velocity of the photosensitive drum 3M and the elapsed time and, further, a broken line indicates the calculation result of the drum/belt driving time calculating procedure 10-2M (the same as that in the embodiment 1). Reference numeral 3C denotes the relation between the rotational peripheral velocity of the photosensitive drum 3C and the elapsed time and, further, a broken line indicates the calculation result of the drum/belt driving time calculating procedure 10-2C (the same as that in the embodiment 1). Reference numeral 3Y denotes the relation between the rotational peripheral velocity of the photosensitive drum 3Y and the elapsed time. The belt (5) shows the relation between the conveying speed of the belt and the elapsed time. The common time showing the change point of each diagram is shown at the bottom stage and the time calculated by the drum/belt driving time calculating procedure 10-2 (K, Y, M, C, V) in the embodiment is also shown under the common time.

The operations of the photosensitive drums 3 (K, Y, M, C) and the belt (5) will now be described in accordance with the time shown in FIG. 11B. It is assumed that acceleration at the time of accelerating the photosensitive drums 3 (K, Y, M, C) and the belt (1, 2) and that at the time of decelerating them are equal.

Time T41 (=T1):

By the drum/belt drive starting procedure 10-1 (K, Y, M, C, V), the rotation of the four photosensitive drums 3 (K, Y, M, C) is simultaneously started and the conveyance of the belt (5) is also simultaneously started.

Time T42 (=T2):

After the rotational speeds of the four photosensitive drums 3 (K, Y, M, C) and the conveying speed of the belt (5) reach predetermined speed (A0), the rotation or the conveyance of the predetermined speed is continued.

Time T43 (=T3):

The reference mark detecting unit 5Y (FIG. 10) detects the mark 4Y (FIG. 10). In FIG. 11A, this time is the time when the photosensitive drum 3Y finishes the rotation of $\pi/4$.

Time T44 (=T4):

The reference mark detecting unit 5K detects the mark 4K (FIG. 10). In FIG. 11A, this time is the time when the photosensitive drum 3K finishes the rotation of $3\pi/4$. A time interval from time T43 to time T44 is assumed to be t1.

Time T45 (=T5):

The reference mark detecting unit 5M detects the mark 4M (FIG. 10). In FIG. 11A, this time is the time when the photosensitive drum 3M finishes the rotation of $\pi$. A time interval from time T43 to time T45 is assumed to be t2.

Time T46 (=T6):

The reference mark detecting unit 5C detects the mark 4C (FIG. 10). In FIG. 11A, this time is the time when the photosensitive drum 3C finishes the rotation of $3\pi/2$. A time interval from time T43 to time T46 is assumed to be t3. At this point of time, the drum/belt driving time calculating procedure 10-2 (K, Y, M, C, V) (FIGS. 11A and 11B) calculate so as to start the deceleration of the photosensitive drum 3K after t1, start the deceleration of the photosensitive drum 3M after t2, and start the deceleration of the photosensitive drum 3C after t3 by using the photosensitive drum 3Y as a reference in a manner similar to the case of the embodiment 1.

On the basis of the calculation results, the drum/belt speed changing procedure 30-1 (K, Y, M, C, V) (FIG. 10) calculate so as to change the speed of the photosensitive drum 3Y to 0, change the speed of the photosensitive drum 3K to A0 (t1/t21), change the speed of the photosensitive drum 3M to A0 (t2/t21), change the speed of the photosensitive drum 3C to A0 (t3/t21), and change the speed of the belt (5) to A0·(t1+t2+t3)/4·t21, respectively. t21 is a constant which has been predetermined.

The drum/belt drive stopping procedure 10-3Y (FIG. 10) starts the deceleration of the photosensitive drum 3Y toward the speed 0. The drum/belt drive stopping procedure 10-3K (FIG. 10) starts the deceleration of the photosensitive drum 3K toward the speed A0 (t1/t21). The drum/belt drive stopping procedure 10-3M (FIG. 10) starts the deceleration of the photosensitive drum 3M toward the speed A0 (t2/t21). The drum/belt drive stopping procedure 10-3C starts the deceleration of the photosensitive drum 3C toward the speed A0 (t3/t21). The drum/belt drive stopping procedure 10-3V starts the deceleration of the belt toward the speed A0·(t1+t2+t3)/4·t21.

Time T47:

Since the speed of the photosensitive drum 3C has reached A0 (t3/t21), this speed is continued for a period of time t21 after that. The deceleration is restarted toward the speed 0 at time T52.

Time T48:

Since the speed of the photosensitive drum 3M has reached A0 (t2/t21), this speed is continued for a period of time t21 after that. The deceleration is restarted toward the speed 0 at time T53.

Time T49:

Since the speed of the belt (5) has reached A0·(t1+t2+t3)/4·t21, this speed is continued for a period of time t21 after that. The deceleration is restarted toward the speed 0 at time T54.

Time T50:

Since the speed of the photosensitive drum 3K has reached A0 (t1/t21), this speed is continued for a period of time t21 after that. The deceleration is restarted toward the speed 0 at time T55.

Time T51:

The photosensitive drum 3Y is stopped.

Time T55:

The photosensitive drums 3 (K, M, C) are stopped. Similarly, the belt (5) is also stopped.

In the procedures described above, it should be noted to the following points.

When considering the photosensitive drum 3K as an example, in the embodiment 1, it is rotated at the speed A0 for the period of time t1 after time T46 (=T6). In the embodiment 4, however, it is rotated at the speed A0·(t1/t21) for the period of time t21. A rotation amount in this instance is equal to A0·t1 (embodiment 1)=A0·(t1/t21)·t21 (embodiment 2).

In the case of the photosensitive drum 3M, in the embodiment 1, it is rotated at the speed A0 for the period of time t2 after time T46 (=T6). In the embodiment 4, however, it is rotated at the speed A0·(t2/t21) for the period of time t21. A rotation amount in this instance is equal to A0·t2 (embodiment 1)=A0·(t2/t21)·t21.

In the case of the photosensitive drum 3K, in the embodiment 1, it is rotated at the speed A0 for the period of time t3 after time T46 (=T6). In the embodiment 4, however, it is rotated at the speed A0·(t3/t21) for the period of time t21. A rotation amount in this instance is equal to A0·t3 (embodiment 1)=A0·(t3/t21)·t21.

Therefore, the marks 4 (K, Y, M, C) are set to the same phase in a manner similar to that in the embodiment 1.

Since the speed of the belt (5) is set to the average speed of the four photosensitive drums 3 (K, Y, M, C), the relative speed with each photosensitive drum remarkably decreases and the reduction in life of both of the belt and the photosensitive drum due to the rubbing of them is reduced, so that the occurrence of the deflection in the belt can be prevented. Thus, such an effect that the output image with the small color drift can be obtained is derived.

Embodiment 5

In order to increase a torque obtained from the photosensitive drum driving unit and rotate the photosensitive drum, the torque is increased by decelerating an idle gear by a reduction gear. To reduce manufacturing costs of the gears, the gears are often manufactured by injection molding for injecting a plastic material into a die.

However, according to the injection molding method of injecting the plastic material into the die, the manufacturing steps are liable to be influenced by peculiar manufacturing errors which the die has. Particularly, if two kinds of large and small gears having the same rotary axis and different gear ratios are integratedly molded as a two-speed gear, since the die is complicated, the large peculiar manufacturing errors which the die has occur in the gear.

Therefore, working errors of the gear increase and even if the eccentricity of the photosensitive drum is reduced, a large rotational fluctuation occurs.

Figure 12B:
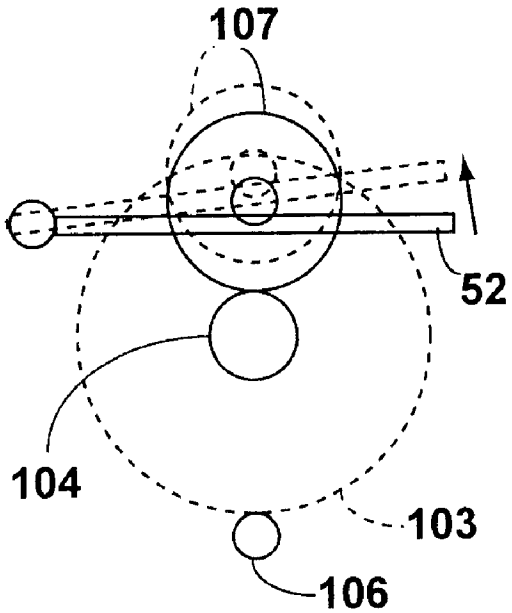
FIGS. 12A and 12B are explanatory diagrams of a main section of an embodiment 5.
Figure 12A:
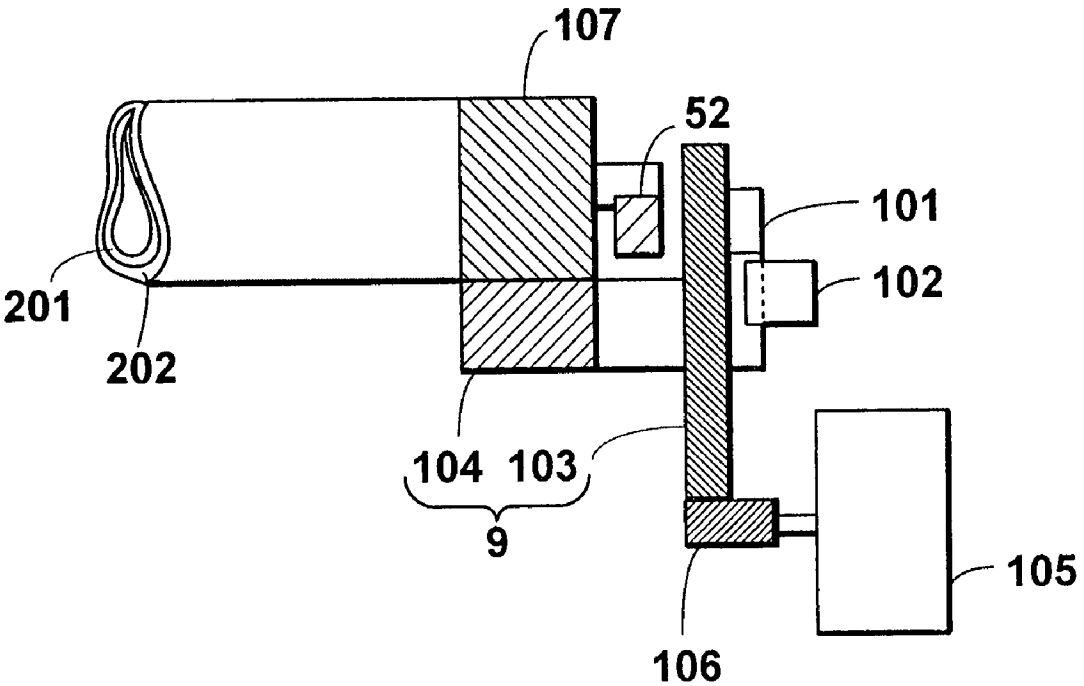
Figure 13:
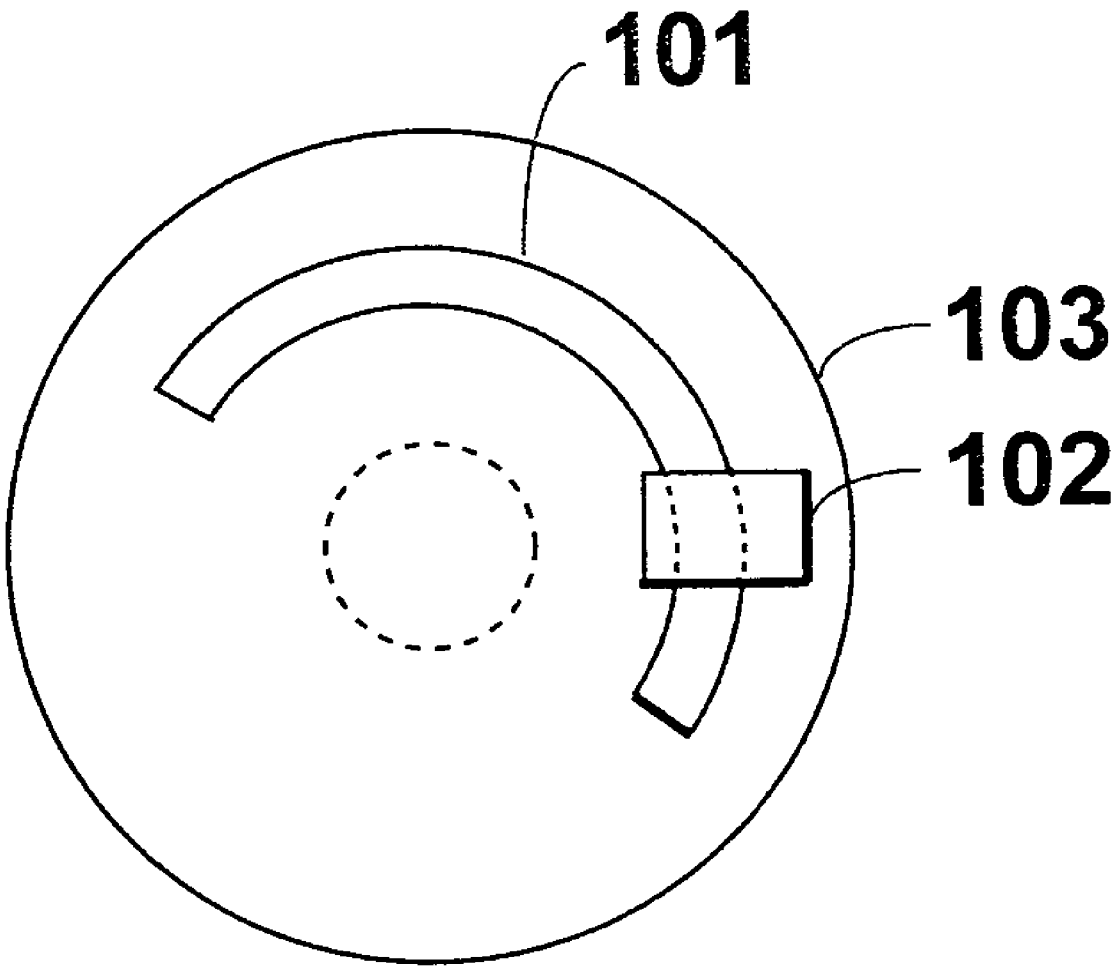
FIG. 13 is a diagram showing a photodetecting mechanism of the embodiment 5.

In the embodiment, as shown in FIGS. 12A, 12B, and 13, each of the photosensitive drum driving gears 9 (K, Y, M, C) has: an idle gear 103 of a large diameter; and a reduction gear 104 which is come into engagement with a photosensitive drum gear 107 coaxially fixed to a side edge of the photosensitive drum 3. The idle gear 103 and the reduction gear 104 are coaxially formed by the injection molding. An arc-shaped light shielding member 101 is provided for a plate surface of the idle gear 103. A photodetecting sensor 102 is arranged in each fixing position.

A motor gear 106 attached to a shaft of a drum motor 105 has a diameter of 5 mm and the number of teeth is equal to 11. The motor gear 106 is in engagement with the idle gear 103. A diameter of the idle gear 103 is equal to 45 mm and the number of teeth is equal to 132. A diameter of the reduction gear 104 is equal to 25 mm and the number of teeth is equal to 27.

Each of the photosensitive drums 3 (K, Y, M, C) has a construction in which an electrostatic layer 202 to accumulate static electricity is formed on a cylindrical base 201. The photosensitive drum gear 107 is attached to an edge section of the cylindrical base 201.

The cylindrical base 201 is made of aluminum or the like. The electrostatic layer 202 is formed by coating an organic photoconductive material of a negative charging type.

Figure 14:
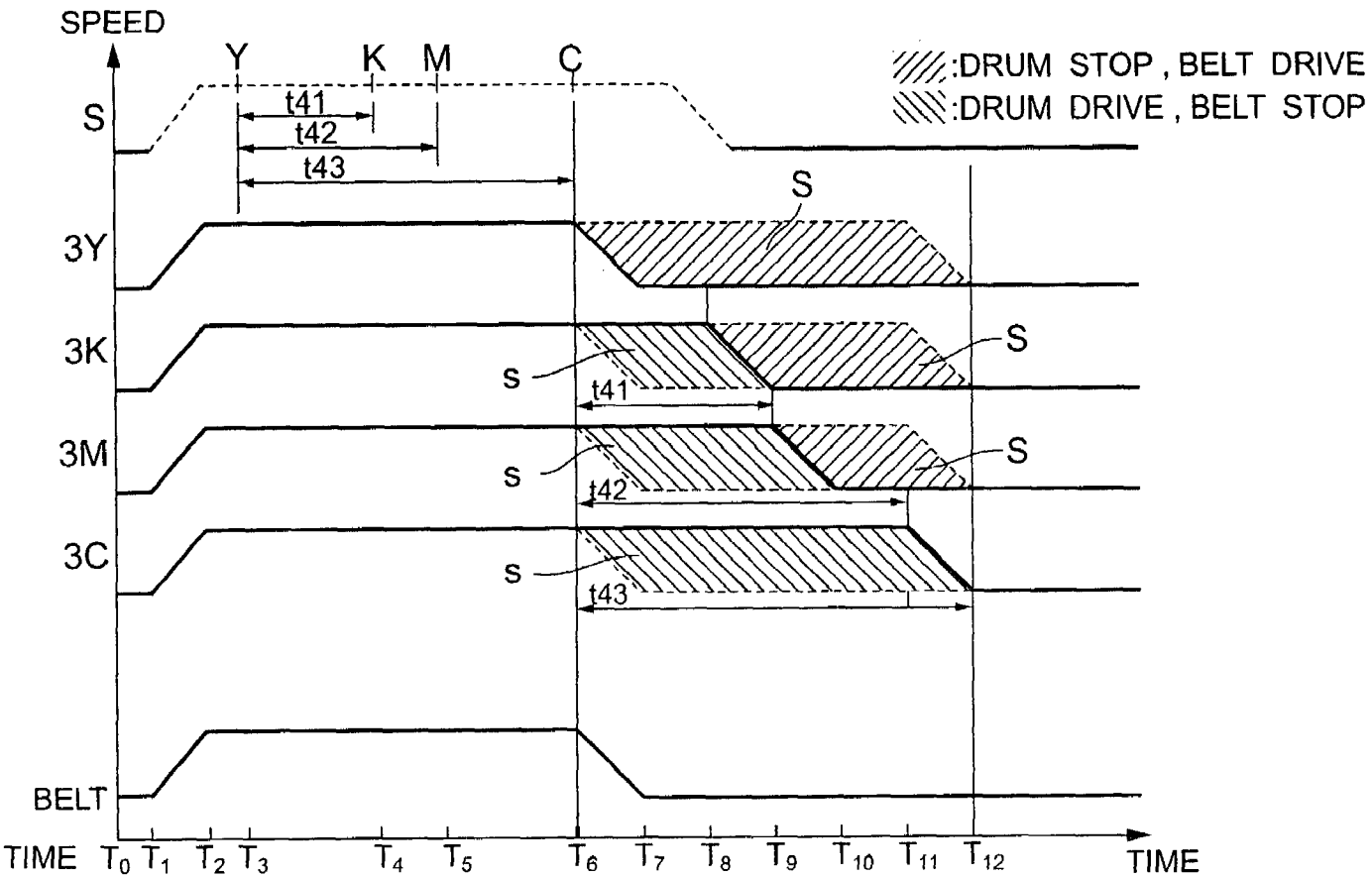
FIG. 14 is an explanatory diagram of a phase difference setting principle of the embodiment 5.

In the embodiment, when the drum motor 105 is driven and each of the photosensitive drums 3 (K, Y, M, C) is rotated through the motor gear 106, the idle gear 103, and the reduction gear 104, for example, an idle gear 103Y corresponding to the yellow photosensitive drum 3Y is rotated and when the light shielding member 101 passes through the photodetecting sensor 102, a detection signal is generated. Subsequently, when other idle gears 103M, 103C, and 103K are rotated, detection signals are generated from the corresponding photodetecting sensors after the elapse of time t41, t42, and t43 as shown in FIG. 14. Therefore, the phase differences (time) of the photosensitive drums 3K, 3Y, 3M, and 3C can be discriminated by the control unit (not shown). When such phase differences are discriminated, as shown in the embodiments 1 to 4, the stop timing of the conveying belt 2 is made to correspond to one of the drum stop timing.

When the embodiment is applied, in the region between the photosensitive drum 3 and the conveying belt 2, since the photosensitive drum 3Y which is stopped at the earliest timing is stopped together with the belt, there is no rubbing. After the belt is stopped, the photosensitive drum 3K is rotated for time t41 in order to match the phase difference. After the belt is stopped, the photosensitive drum 3M is rotated for time t42 in order to match the phase difference. Further, after the belt is stopped, the photosensitive drum 3C is rotated for time t43 in order to match the phase difference. By rotating the photosensitive drums 3K, 3M, and 3C after the belt is stopped as mentioned above, since the rubbing position of each photosensitive drum and the belt is changed, it is possible to prevent the photosensitive body from being locally abraded. Therefore, the life when the image can be normally formed on each photosensitive drum can be extended.

After making the discrimination about the phase differences of the photosensitive drums in the embodiment 1, if discrimination about phase differences of the photosensitive drum driving gears (idle gears 103) in the embodiment 5 is made, the positional deviation of each of the photosensitive drums and the photosensitive drum driving gears can be reduced, so that it is more preferable.

In this case, there are provided contact/separating units 52Y, 52M, 52C, and 52K for allowing reduction gears 104Y, 104M, 104C, and 104K of the photosensitive drum driving gears 9Y, 9M, 9C, and 9K to be come into contact with or removed from the photosensitive drum gears 107Y, 107M, 107C, and 107K of the photosensitive drums 3Y, 3M, 3C, and 3K.

That is, the contact/separating units 52Y, 52M, 52C, and 52K are moved downward and in the state where the reduction gears 104Y, 104M, 104C, and 104K are come into engagement with the photosensitive drum gears 107Y, 107M, 107C, and 107K of the photosensitive drums 3Y, 3M, 3C, and 3K, the positions of the photosensitive drums 3Y, 3M, 3C, and 3K in the embodiment 1 are adjusted. After that, the contact/separating units 52Y, 52M, 52C, and 52K are moved upward, the reduction gears 104Y, 104M, 104C, and 104K are removed from the photosensitive drum gears 107Y, 107M, 107C, and 107K, and the positions of the photosensitive drum driving gears 9Y, 9M, 9C, and 9K are adjusted. After the positions of the photosensitive drum driving gears 9Y, 9M, 9C, and 9K are adjusted, the contact/separating units 52Y, 52M, 52C, and 52K are moved downward and the reduction gears 104Y, 104M, 104C, and 104K are come into engagement with the photosensitive drum gears 107Y, 107M, 107C, and 107K. After that, the image is formed by the image forming apparatus.

The torque which is necessary for the motor of the belt driving unit is decrease to reduce the costs of the belt driving unit. However, in the case of stopping each photosensitive drum with the time difference as in the embodiment, if the motor of the belt driving unit is stopped in accordance with the state where the number of stopped photosensitive drums is small, particularly, in accordance with the stop of the driving of the photosensitive drum which is first stopped, the frictional load occurring since the belt is conveyed in the state where the photosensitive drum is stopped and come into contact with the belt can be distributed to the drum motor of each photosensitive drum driving unit. The situation where only the motor of the belt driving unit is set to a torque which is extremely higher than the torque that is necessary in the normal printing mode can be lightened.

In this case, the torque can be distributed to each of the photosensitive drum motors in consideration of the frictional load. When the medium serving as a load is conveyed to a position between the belt and the photosensitive drum by the printing operation, the print data can be printed up to a medium of a high load as compared with the case where only the motor of the belt driving unit can endure a high load.

The static layer 202 to accumulate the static electricity is formed on the photosensitive drum 3. A deposition amount of the toner as a developing agent is determined in accordance with a state of electricity appearing on the surface of the static layer 202. Since the toner image formed on the photosensitive drum is constructed by dots of toner particles, if the belt is conveyed in the state where the photosensitive body is stopped, the static layer 202 on the surface of the photosensitive drum is locally abraded. If the static layer 202 is locally abraded as mentioned above, a large variation occurs in the electrostatic coercive force of the surface of the photosensitive body or the state of the electricity appearing on the surface of the static layer 202 and a large variation occurs in the deposition of the toner, so that the normal toner image cannot be formed. Therefore, as shown in FIG. 14, by stopping the belt 2 together with the photosensitive drum 3Y which is first stopped, the occurrence of the deposition variation can be prevented.

In each of the foregoing embodiments, in the case of putting the recording medium onto the belt 2 and conveying it, since the recording medium is in area-contact with the belt 2, even if the belt 2 is locally rubbed, a decrease in conveying force of the recording medium is small.

Although the invention has been described in the case where it is applied to the printing apparatus such as a color electrophotographic printer or the like, the invention is not limited to such an example. That is, it can be also applied to a facsimile apparatus, a copying apparatus, and the like.

The present invention is not limited to the foregoing embodiments but many modifications and variations are possible within the spirit and scope of the appended claims of the invention.

What is claimed is:

1. An image forming apparatus comprising:

a first photosensitive body and a second photosensitive body;

a first driving unit which gives a driving force to said first photosensitive body and a second driving unit which gives a driving force to said second photosensitive body;

a belt which is arranged between said first photosensitive body and said second photosensitive body;

a first mark whose position changes when said first photosensitive body rotates and a second mark whose position changes when said second photosensitive body rotates;

a first detecting unit which detects said first mark and a second detecting unit which detects said second mark; and a control unit which obtains a time difference between timing when said first mark passes through said first detecting unit and timing when said second mark passes through said second detecting unit, determines a time that is required until said second driving unit is stopped after the stop of said first driving unit, and set stop timing of said belt driving unit to timing between the stop of said first driving unit and the stop of said second driving unit.

2. The apparatus according to claim 1, wherein said first photosensitive body has a first photosensitive body gear which receives the driving force from said first driving unit, said second photosensitive body has a second photosensitive body gear which receives the driving force from said second driving unit, a position of said first mark is rotated synchronously with rotation of said first photosensitive body gear, and a position of said second mark is rotated synchronously with rotation of said second photosensitive body gear.

3. The apparatus according to claim 1, wherein said control unit stops said belt driving unit together with the stop of said first driving unit and, thereafter, stops said second driving unit.

4. The apparatus according to claim 1, further comprising:

a first photosensitive body driving gear which has said first mark, receives the driving force from said first driving unit, and rotates said first photosensitive body; and a second photosensitive body driving gear which has said second mark, receives the driving force from said second driving unit, and rotates said second photosensitive body.

5. The apparatus according to claim 4, wherein said control unit stops said belt driving unit together with the stop of said first driving unit and, thereafter, stops said second driving unit.

6. An image forming apparatus comprising:

a plurality of photosensitive bodies and a plurality of driving units which rotate said photosensitive bodies;

a belt driving unit which drives a belt that is come into contact with said plurality of photosensitive bodies;

a plurality of detection sections which are rotated in association with the rotation of said photosensitive bodies;

a plurality of detecting units each of which is arranged so as to face each of said rotated detection sections at a same fixing position and outputs a detection signal when each of said rotated detection sections is detected at the facing position;

a drive control unit which simultaneously drives said plurality of driving units and drives said belt driving unit so as to simultaneously rotate said plurality of photosensitive bodies;

a stop control unit which discriminates rotational phase differences of said photosensitive bodies on the basis of a reception time difference each time a detection signal is received from each of said detecting units and sequentially stops the driving units of said photosensitive bodies in correspondence to said rotational phase differences; and a belt drive stopping unit which stops said belt driving unit before the driving unit whose stopping order is the last is stopped after said driving unit whose stopping order is the first was stopped.

* * * * *